US006769965B2

(12) United States Patent
Katayama

(10) Patent No.: US 6,769,965 B2
(45) Date of Patent: Aug. 3, 2004

(54) DRILL BIT POINTING AND DIRT REMOVAL APPARATUS AND METHOD

(76) Inventor: Ichiro Katayama, 2-59-224, Takamachi, Nagaoka City (JP)

( * ) Notice: Subject to any disclaimer, the term of this patent is extended or adjusted under 35 U.S.C. 154(b) by 30 days.

(21) Appl. No.: 10/127,356

(22) Filed: Apr. 19, 2002

(65) Prior Publication Data

US 2002/0174989 A1 Nov. 28, 2002

(30) Foreign Application Priority Data

Apr. 20, 2001 (JP) ..... 2001-122896

(51) Int. Cl.[7] ..... B24B 1/00
(52) U.S. Cl. ..... 451/48; 451/65
(58) Field of Search ..... 451/48, 49, 444, 451/5, 9, 65; 76/108.1, 108.6

(56) References Cited

U.S. PATENT DOCUMENTS 4,520,595 A * 6/1985 Diener ..... 451/28
5,762,538 A * 6/1998 Shaffer ..... 451/36
6,244,938 B1 * 6/2001 Ploeger ..... 451/65
6,331,133 B1 * 12/2001 Katayama et al. ..... 451/9

* cited by examiner

*Primary Examiner*—Dung Van Nguyen
(74) *Attorney, Agent, or Firm*—William L. Chapin

(57) ABSTRACT

An apparatus for pointing twist drill bits includes a processing unit which has a rotary index plate on which are mounted a plurality, e.g., five, of drill bit holders which are circumferentially spaced apart at equal, e.g., 72-degree intervals, and a loading unit which has located adjacent to the index plate a rotary pedestal on which are mounted an equal number of transfer arms. Located around the periphery of the processing unit and loading unit are a plurality of processing stations and loading unit operation stations, respectively. Under computer control, the index plate and pedestal are periodically rotated non-simultaneously in opposite directions and stopped for predetermined time periods during which sensors and actuators cause drill bits to be loaded from a container located at an input/output station onto a loading unit arm, cleaned, transferred to a drill bit holder, sequentially processed at processing stations, including a point grinding station, transferred back to a loading unit arm, discharged to a defectives container if defective, have a collar ring adjusted, and returned to the input/output station for discharge to a transport container. Prior to and after a grinding process, each drill bit is cleaned by a dirt removal apparatus which uses a plastically deformable body, preferably a toroidal roller which is pivoted into contact with a drill bit point, causing the point to pierce the body and transfer dirt thereto, the body is then pivoted away from the point with dirt adhered to the body.

39 Claims, 16 Drawing Sheets

DRILL BIT POINTING AND DIRT REMOVAL APPARATUS AND METHOD

BACKGROUND OF THE INVENTION

A. Field of the Invention

The present invention relates to methods and apparatus for grinding the front cutting portion or tip of twist drill bits. More particularly, the invention relates to an apparatus and method for automatically grinding or re-pointing twist drill bits that includes automatic means for removing dirt from the drill bit.

B. Description of Background Art

Printed wiring boards (PWB's) used to hold and electrically interconnect electronic circuit components are typically fabricated as laminated stacks of copper foil sheets alternating with insulating sheets made of fiberglass, the latter containing glass fibers imbedded within a solidified resin such as epoxy. Glass fibers are highly abrasive, and can quickly dull drill bits used to drill holes in a PWB for receiving component leads, or for forming passageways or vias through the PWB. A typical PWB has a thickness of about 0.062 inch, and has hundreds of holes drilled through it. Each contact with the upper surface of a PWB to drill a hole is referred to as a "hit." Since PWB's are usually arranged in stacks of two to five boards for drilling, a corresponding number of holes are drilled for each hit. Because the abrasive nature of the PWB board materials dulls typical drill bits after about 3000–5000 holes are drilled, drill bits used for such applications must be removed from service and re-sharpened after about 1,500–2,500 hits.

In conventional drill bit grinding apparatus used to sharpen or re-point twist drill bits, the drill bit must be held in a chuck while being re-pointed. Consequently, the operator must manually perform operations such as inserting the drill into the chuck of a drill bit holder mechanism, tightening the chuck to grip the drill, positioning or aligning the drill in relation to the drill bit holding mechanism and to rotary grinding stones, advancing the drill bit towards grindstones, retracting the re-pointed drill bit from the grindstones and removing the re-pointed drill bit. Because of all of the aforementioned operations, an operator can usually operate only a single drill bit grinding apparatus at a time. Thus, even an experienced operator can typically re-point no more than about 800 to 1,000 drill bits over an eight-hour work shift. Therefore, there has been a strong demand for an automated drill bit re-pointing apparatus that has a higher throughput rate than existing re-pointing apparatuses, and which may be operated by less than highly skilled personnel. Thus, for the small twist drill bits which are used to drill holes in printed wiring boards (PWB's), equipment has been developed for re-pointing the front cutting portion of the bits including the tips, to thereby prolong the life span of bits which would otherwise have to be disposed of for not meeting dimensional tolerance requirements. Traditionally, the re-pointing process requires as an initial step removal of dirt which has inadvertently adhered to the drill bit. According to customary prior art methods, dirt is removed from a bit prior to re-pointing the bit by momentarily directing a blast of compressed air onto the surface of the bit. Next, the bit is installed in a clamping mechanism, and adjusted to a precisely pre-determined spatial position and angular orientation or phase angle of the flutes relative to abrasive grinding wheels. The grinding wheels are then brought into contact with the front cutting portion of the bit while the shank is rotated about the longitudinal axis of the bit to thereby vary the angular orientation or phase angle of the fluted portion of the bit presented to the grinding wheels. Upon completion of the grinding operation, the bit must be cleaned a second time, to remove particles of grindstone material, metal chips, or oil which may have adhered to the bit. A quality control inspection is then made of the bit to determine whether or not the bit meets pre-determined quality control criteria. Also, a ring-shaped collar is then customarily press-fitted onto the drill bit shank to identify the size of the bit and to limit its insertion depth into a workpiece.

Existing drill bit re-pointing apparatus functioning as described above experience certain problems which limit their effectiveness. For example, typical existing drill bit re-pointing methods utilize physically separated work stations to perform the various steps required in the re-pointing process. This arrangement has the disadvantage of requiring time and personnel to transport drill bits between the respective re-pointing stations, and of requiring a relatively large installation space for the various pieces of required equipment located at physically separated stations.

Moreover, in utilizing prior art methods for removing dirt from drill bits to prepare the bits for re-pointing, compressed air commonly used for dirt removal is problematic for several reasons. First, the small size of the bits and the preciseness of the re-pointing operation necessitates that the compressed air have a relative higher level of purity than normally required and supplied for typical factory production operations. Second, use of compressed air produces undesirable noise. Third, blasting dirt off a bit with compressed air causes the dirt to be scattered in an uncontrolled fashion to areas adjacent to the air gun.

In view of the problems mentioned above, the present invention was conceived to accomplish the following objectives.

OBJECTS OF THE INVENTION

An object of the present invention is to provide an automatic re-pointing apparatus and method for twist drill bits in which batches of drill bits may be re-pointed by a sequence of steps performed at a single location by an automatic re-pointing apparatus.

Another object of the invention is to provide apparatus and method for removing dirt from a drill bit to be re-pointed, by an automatic removal apparatus which does not require use of compressed air.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an apparatus for pointing twist drill bits, the apparatus including at least one and preferably two dirt removal mechanisms.

A drill bit pointing and dust removal apparatus according to the present invention includes a drill bit processing unit which has a rotary index plate on which are mounted a plurality of circumferentially spaced apart drill bit holder units. Spaced radially apart from the periphery of the index plate are a plurality of circumferentially spaced apart, fixed drill bit processing stations where separate processing units each perform a separate processing function on an individual drill bit which has been rotated by the index plate into position adjacent to a particular station. Spaced radially apart from the periphery of the rotary pedestal are a plurality of circumferentially spaced apart operation stations where separate operation units each perform a separate operation on an individual drill bit which has been rotated by the rotary pedestal into position adjacent to a particular operation station. The loading unit includes a loading unit which has a rotary pedestal on which are located a plurality of circumferentially spaced apart transfer arms, each adapted to hold a separate drill bit. The apparatus includes actuator mechanisms which transfer an individual bit from an arm on the loading unit rotary pedestal to an individual drill bit holder on the processing unit index plate at the beginning of a drill bit processing cycle, and from an individual drill bit holder to an arm on the loading unit base plate at the end of a process cycle. The loading unit rotary pedestal is then rotated to transfer a processed drill bit to a reject container station, ring adjustment station, and input/output station located in a circle around the periphery of the loading unit pedestal, to be scrapped if defective, or fitted with an identification ring and unloaded from the loading unit base plate into a transport container for transport away from the apparatus, e.g., to a shipping location.

The apparatus according to the present invention includes position control mechanisms which consist of operatively interactive sensors and actuators located at fixed processing stations and on each multi-purpose drill bit holder unit on the processing unit index plate. The position control mechanisms include a tip position adjustment mechanism which maintains the tip of a drill bit in a predetermined, fixed position, a center adjustment mechanism that positions the center of the drill bit core at a predetermined elevation, and a phase-adjustment mechanism which adjust the rotation angle or phase of the bit to predetermined values.

According to the invention, a drill bit to be subjected to re-pointing and/or other processes by the apparatus is first loaded onto an arm on the rotary pedestal of the loading unit at an input/output station. The rotary pedestal is then rotated to a pre-grind dirt removal operation station, where dirt is removed from the drill bit. Next, the rotary pedestal is rotated to a load/unload station adjacent to the processing unit, where the pre-cleaned bit is transferred to the index plate of the processing unit. According to the invention, an individual drill bit in a holder on the processing unit index plate successively encounters a series of drill bit processing stations located adjacent to the periphery of the processing unit index plate, including in order, an optical tip position set up sensing and alignment station for providing control signals which are used to adjust the position of the drill bit, a grinding station, a second, post-grind dirt removal station, and an optical inspection station.

A dirt removal apparatus for removing dirt from a drill bit tip according to the present invention includes a plastically deformable body which has a tacky surface, and an actuator mechanism for bringing the body into contact with a drill bit tip, whereupon dirt lightly adhered to the drill bit adheres more strongly to the tacky surface of the body, thus removing the dirt from the bit when the body is retracted from the bit. In a preferred embodiment, the dirt removal body has the form of a rotatable toroidal roller made of a synthetic polymer such as poly-isobutylene, that is easily deformable and has a tacky surface. The actuator mechanism pivots the toroidal roller into contact with a drill bit tip to clean the tip, and pivots the roller away from the tip, with dirt originally adhered to the drill bit surface now adhered to the roller. Pivotal motion of the dirt removal toroidal roller away from the tip causes the roller to rotate relative to silicone rubber dressing rollers which contact surfaces of the toroidal roller to thereby re-shape and re-surface the toroidal body, after it has been deformed and soiled in the process of cleaning a drill bit, thus preparing the toroidal roller to contact and clean a next drill bit.

Repointing of drill bits according to the method of the present invention includes the following steps. First, a drill bit is loaded onto one of the plurality of drill bit transfer arms mounted on the rotary pedestal of the loading unit which is adjacent to an input/output, or carry in/carry out station spaced radially outwards from the periphery of the loading unit base plate. The loading unit rotary pedestal is then rotated a predetermined angle to position the bit adjacent to a first, pre-grind dirt removal processing station, where the bit is cleaned: the loading unit rotary pedestal is then rotated a predetermined angle to a loading/unloading transfer station located between the loading unit and processing unit, where the cleaned bit is then loaded onto an empty drill bit holder on the processing unit index plate by actuation of the transfer arm holding the bit. The processing unit index plate is then rotated a first angular increment to locate the bit holder and bit adjacent to a tip position set up processing station where an electro-optical sensing apparatus views the bit and in response to that view, produces control signals which are applied to actuator mechanisms which adjust the position of the tip of the drill bit to a predetermined location in the field of view of the sensing apparatus, adjust the height of the center of the bit, and adjust the rotation angle or phase angle of the fluted portion of the tip to a predetermined angle relative to a reference plane. The index plate is once again incrementally rotated to position the drill bit holder and drill bit adjacent to a grinding wheel station which has a pair of rotating grindstones mounted on a traverse mechanism which translates the rotating grindstones forcibly against surfaces of a drill bit to thereby automatically grind the tip to a predetermined shape. The index plate is again rotatably incremented to position the drill bit holder and bit adjacent to a second, post-grind dirt removal station, where the bit is again cleaned. Next, the index plate is incrementally rotated to position the ground and cleaned re-pointed drill bit adjacent to an electro-optical inspection station, which uses a computer and pattern recognition logic to determine whether the re-pointed drill bit meets size and shape specifications. The index plate is once again rotated to position the drill bit holder holding the re-pointed, cleaned, and inspected drill bit back at the loading/unloading transfer station, adjacent to an empty transfer arm on the pedestal of the loading unit, whereupon the transfer arm is actuated to grasp and remove the processed bit. The loading unit rotary pedestal is then incrementally rotated to position the transfer arm holding the re-pointed bit adjacent to a reject container, at which location the arm is actuated to deposit a rejected bit into the reject container. The loading unit rotary pedestal is then incrementally rotated to position the transfer arm holding an acceptable re-pointed drill bit adjacent to a ring installation unit, where an identifying ring press-fitted onto the shank of the bit is adjusted to a proper distance from the drill bit tip. The loading unit rotary pedestal is then incrementally rotated to position the drill bit transfer arm holding a finished re-pointed bit adjacent to the input/output station, where the transfer arm transfers the bit to a transport container.

The processing unit index plate and loading unit pedestal have equal numbers, e.g., five, of drill bit holders and transfer arms, respectively, which are separated by the same central angles, e.g., 72 degrees. Also, the relative positions and movements of the drill bit holders and transfer arms, as well as functions of the processing and loading stations, are synchronized by a transport control unit, which comprises a microprocessor or general purpose computer such as a PC, which also synchronizes rotations of the processing unit index plate and the loading unit pedestal. Therefore, each of the foregoing operations described at the various stations adjacent to the processing unit and loading unit are performed simultaneously on five different drill bits, thus resulting in a high processing through-put rate.

DESCRIPTION OF THE PREFERRED EMBODIMENT

FIGS. 1–18 illustrate the structure and function of a drill bit pointing and dust removal apparatus and method according to the present invention. From the ensuing description, it will be clear that certain novel components of the apparatus and method may be used apart and/or independently from the apparatus and method as a whole. For example, the novel dirt removal unit described below may be used independently of other components of the apparatus.

Figure 1:
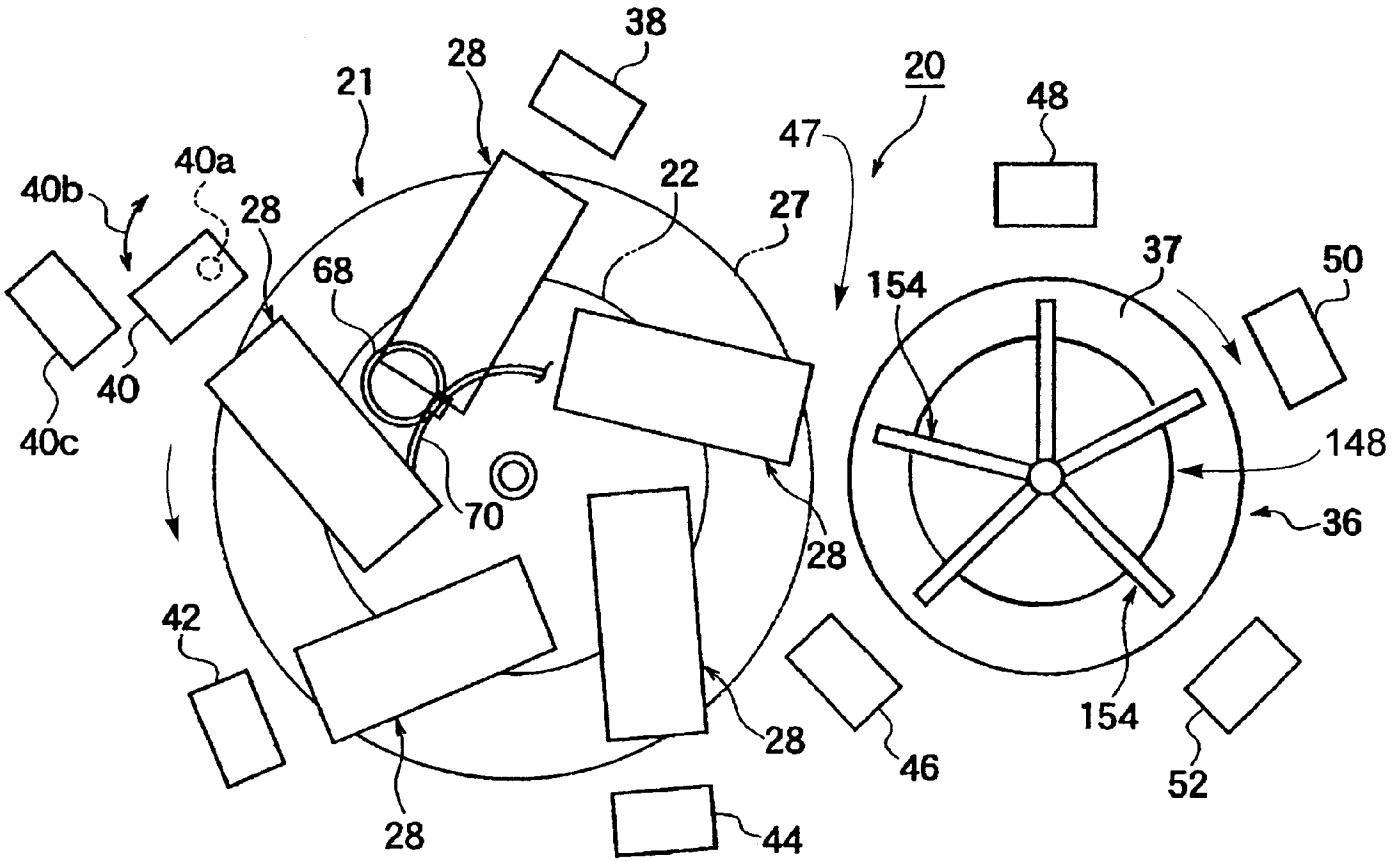
FIG. 1 is a partly diagrammatic upper plan view of a drill bit pointing and dust removal apparatus according to the present invention.
Figure 2:
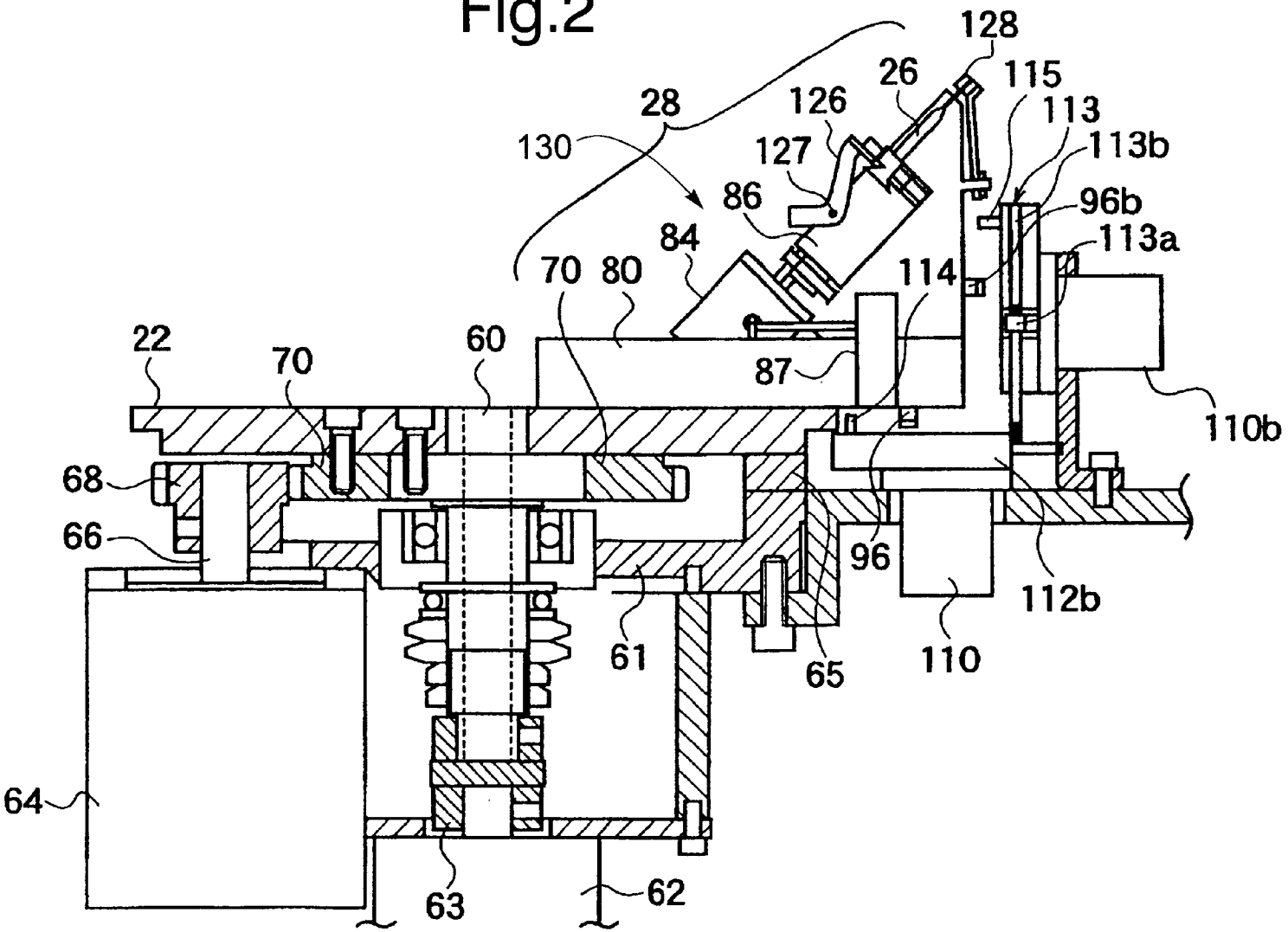
FIG. 2 is a partly sectional elevation view of a transport mechanism and drill bit holder of the apparatus of FIG. 1.

Referring first to FIG. 1, an automatic drill bit pointing/re-pointing and dust removal apparatus 20 according to the present invention may be seen to include a drill bit processing unit 21 which includes a base plate 27 and a longitudinally disposed circular disk-shaped index plate 22 supported above the base plate and rotatable with respect to the base plate. Re-pointing apparatus 20 also includes a loading unit 36 that has a base plate 37 which rotatably supports a plurality of circumferentially spaced apart drill bit manipulating arm mechanisms 154 mounted on a rotary pedestal 148 supported above the base plate and rotatable in a plane parallel and adjacent to index plate of processing unit 21. Mounted onto the upper surface of index plate 22 of processing unit 21 are a plurality of circumferentially spaced apart drill bit holder units 28 each adapted to hold an individual drill bit 26, as shown in FIG. 2. In a preferred embodiment, index plate 22 mounts five drill bit holder units 28 spaced apart from one another at 72-degree intervals. Also, rotary pedestal 148 of loading unit 36 preferably mounts five arm mechanisms 154 spaced apart from one another at 72-degree intervals.

Surrounding index plate 22 of processing unit 21 is a fixed arrangement of circumferentially spaced apart drill bit processing units or stations of various types, the structure and function of which are described in detail below. The processing units include a pre-grind dirt removal unit 46, tip position setup unit 38, grinding unit 40, post-grind dirt removal unit 42, and inspection unit 44. The five above-described drill bit processing units are spaced apart at the same angular increments as drill bit holder units 28. Thus, when index plate 22 is rotated to position a particular drill bit holder 28 adjacent to a particular processing unit, e.g., pre-grind dirt removal unit 46, for the purpose of performing a process step on a particular drill bit held by that holder, the other four drill bits held by the other four drill bit holders 28 will be positioned adjacent to respective ones of the four other processing units. This arrangement enables apparatus 20 to sequentially perform five different processes on five individual drill bits simultaneously.

As shown in FIG. 1, each drill bit holder unit 28 is installed obliquely to the radial direction of index plate 22. Thus, the maximum radial projection of drill bit holder unit 28 beyond the periphery of index plate 22 is minimized, thereby minimizing the floor space area or footprint required for processing unit 21. The oblique orientation of drill bit holder units 28 relative to index plate 22 also locates the tips of drill bits held in the holder units close to the center of index plate, thus enabling drill bit tips to be more precisely positioned relative to peripheral processing units for a given error tolerance in the angular rotation angles of the index plate. In addition to the advantage of arranging drill bit holders 28 obliquely relative to radii of index plate 22, as shown in FIG. 1, each holder 28 is so constructed as to hold a drill bit 26 at an oblique angle, e.g., 45 degrees to the plane of index plate 22, as shown in FIG. 2. This arrangement reduces bending of a drill bit 26 during processing, and further improves the precision with which the drill bit may be located relative to a processing station.

An understanding of the structure and function of index plate 22 may be facilitated by reference to FIG. 2, which shows an individual one of a plurality of drill bit holder units 28 mounted to the index plate. As shown in FIG. 2, in the center of index plate 22 is installed a cylindrical revolving shaft 60 which is electrically coupled to a revolving electrode 62 via a cylindrical coupling 63. Inside the bore of revolving shaft 60 is disposed an electrical cable (not shown) which is connected at one end to a motor 84 which is used for a phase adjustment that is described later, conductors of the cable being connected at the other end of the cable to revolving electrode 62. Because the cable revolves in unison with revolving shaft 60, twisting of the cable is prevented.

Horizontally aligned with a lower part of revolving shaft 60 is an index drive motor 64 which is fastened to a support 61. Index drive motor 64 has a shaft 66 which protrudes vertically upwards from the motor housing. A driving gear 68 fixed to the upper end of motor shaft 66 meshes with and rotatably drives a driven gear 70 attached concentrically to the lower surface of index plate 22. Thus, when motor 64 is supplied with electrical power, motor shaft 66, driver gear 68, driven gear 70 and index plate 22 are rotated. Motor 64 is controlled so that each of the drill bit holder units 28 on index plate can be sequentially brought into position and stopped facing each of the above-mentioned processing units. A ring-shaped thrust bearing 65 mounted concentrically below index plate 22 rotatably supports the index plate, the thrust bearing having a notch which provides clearance for driving gear 68.

Figure 3:
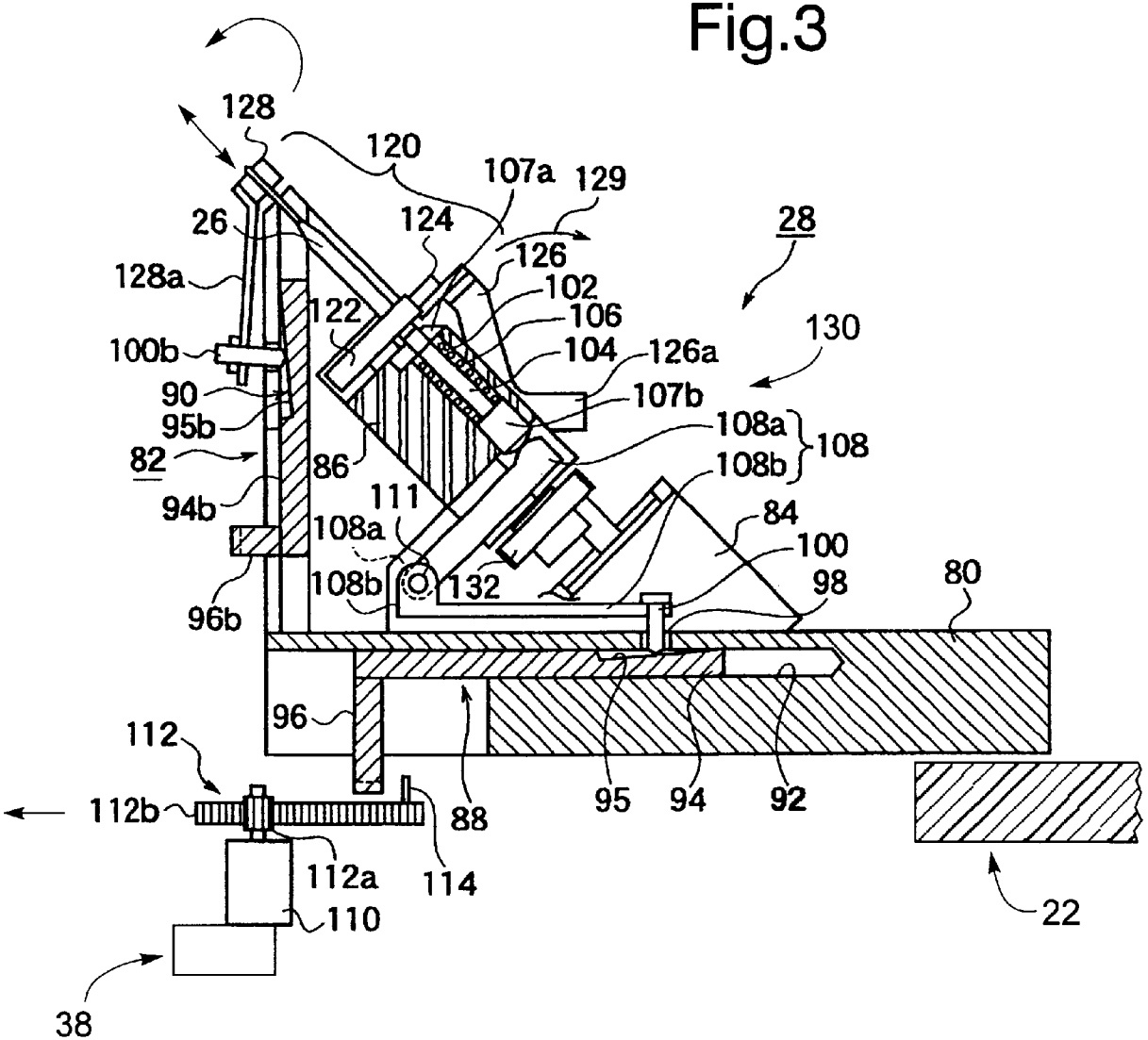
FIG. 3 is a vertical longitudinal sectional view of the drill bit holder of FIG. 2.

Drill bit holder unit 28, shown in elevation view in FIG. 2, is shown in a more detailed, partly sectional view in FIG. 3. The function of drill bit holder unit 28 is to hold the tip of a drill bit 26 in a vertical plane, at an oblique angle, e.g., 45 degrees, with respect to the upper horizontal surface of index plate 22. Holder unit 28 has a base 80 installed above index plate 22. As shown in FIG. 3, holder unit 28 includes a vertically disposed mount or support structure 82 which protrudes upwardly from base 80, near the outer circumferential side or peripheral edge of index plate 22. Fixed to the outer side of support structure 82 is an edge receptacle section 128 for supporting the front fluted cutting portion of a drill bit 26.

As shown in FIGS. 2 and 3, drill bit holder 28 has a phase angle adjuster mechanism 130 which includes a motor 84 for adjusting the phase of drill bit 26. Phase is here defined as the rotation angle or polar angle about the longitudinal axis of the bit of structural features such as the chisel point or flutes of the drill bit tip, relative to a fixed reference plane containing the longitudinal axis. As shown in FIGS. 2 and 3, phase adjuster motor 84 is located near the center of base plate 80, the motor having an output shaft angled upwardly and radially outward at an oblique angle, e.g., 45 degrees from base plate 80. A block-shaped phase mechanism support body 86 located between motor 84 and drill bit 26 supports the butt end of the drill bit shank, and contains a mechanism driven by the motor shaft for rotating the bit around the longitudinal axis of the shank to thereby adjust the phase angle of the bit, as will be described below.

Figure 4:
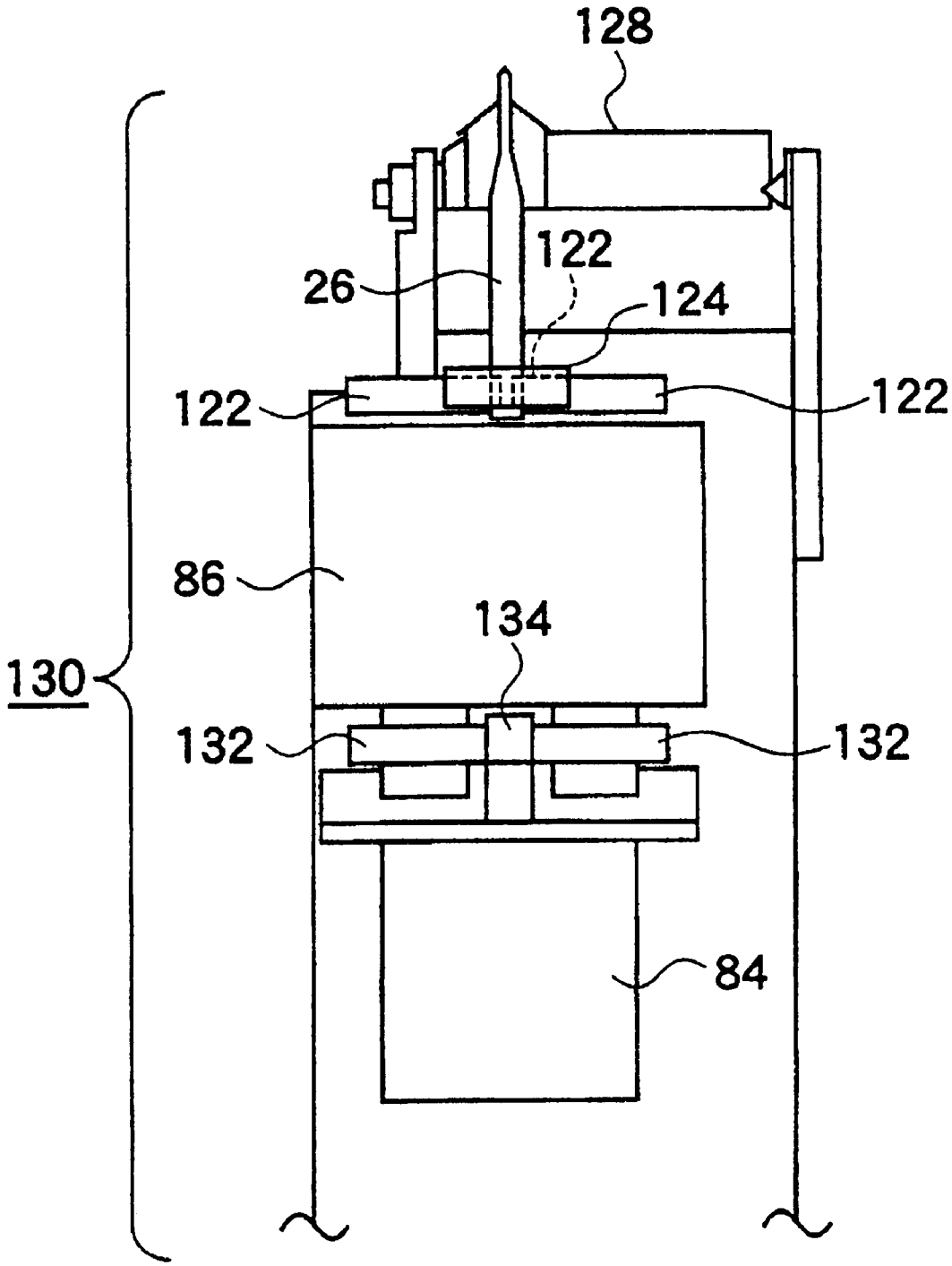
FIG. 4 is an upper plan view of a drill bit phase adjustment mechanism comprising part of the apparatus of FIG. 1.

The structure and function of a drill bit support mechanism 120 which functions with phase angle adjustment mechanism 130 may be best understood by referring to FIG. 4 in addition to FIGS. 2 and 3. As shown in FIG. 4, the shank of a drill bit 26 is rotatably supported on adjacent circumferential surfaces of a pair of laterally spaced apart rubber rollers 122, which are located at the outer, front, or "tip" side of phase mechanism support body 86. The drill bit shank is held rotatably in contact with rollers 122 by a ring-shaped idler bearing 124 rotatably mounted at the end of an L-shaped pivot arm 126, the lower surface of the idler bearing pressing down against the upper surface of the shank when pivot arm 126 is pivoted downwards towards the shank, as shown in FIG. 3. A spring (not shown) biases pivot arm 126 in a downward direction, thus causing idler bearing 124 to be resiliently pressed against the upper surface of a drill bit shank.

As shown in FIG. 3, pivot arm 126 has an L-shaped cross section, and includes a short rear tail side leg 126A which protrudes outwardly relative to phase mechanism support body 86. A driver cam (not shown) having a surface pressuring against leg 126A of pivot arm 126 is rotated to rotate pivot arm 126 on fulcrum arm 127 (see FIG. 2) in the direction of the arrow mark 129 in FIG. 3. With pivot arm 126 and idler bearing 124 pivoted clockwise from the position shown in FIG. 3, a drill bit 26 may be removed from or inserted in place on rollers 122 of drill holder mechanism 126.

The operation of phase adjustment mechanism 130 of drill bit holder unit 28 may be best understood by referring to FIG. 4. As shown in FIG. 4, drill bit phase adjustment mechanism 130 includes a pair of laterally spaced apart gear wheels 132 which are each fixed to the rear end of a separate one of a pair of parallel, longitudinally disposed drive shafts (not shown) rotatably held within support block 86. Gear wheels 132 mesh with a pinion gear 134 fixed to the shaft of phase control motor 84. The above-mentioned drive shafts protrude forward from support body 86, where they are fixed to adjacent rollers 122. Thus, when the shaft of motor 84 is rotated in response to control signals, gear wheels 132 and rollers 122 are rotated in unison, thus rotating the shank of drill bit 26, which is pressed against rollers 122 by idler bearing 124, to a particular phase angle.

As shown in FIG. 3, drill bit holder unit 28 includes a horizontal slider system 88 for precisely adjusting the axial tip position of a drill bit 26 held by the holder unit, and a vertical slider system 90 for adjusting the inclination angle of the drill bit. Horizontal slider system 88 includes a horizontally disposed plate 94 which is radially slidably located within a horizontally disposed groove 92 within base 80. Plate 94 has located at an inner radial end thereof a downwardly protruding lever 96. Plate 94 also has formed near an inner radial end thereof, in the upper surface thereof, a wedge-shaped depression 95 which has a lower surface which slopes downwardly and radially outwardly. In a web portion of base plate 80 above depression 95 is a vertically disposed cylindrically through-bore 98 which penetrates the lower surface of the web and the upper surface of the base plate. A cylindrically-shaped headed pin 100 is vertically reciprocally located in bore 98. Pin 100 has a lower convex surface which slidably rides on the sloping bottom surface of depression 95.

Horizontal slider system 88 includes a motor 110. Motor 110 is located below lever 96, and fixedly mounted to a support structure (not shown) comprising part of tip position set-up processing unit 38, spaced radially apart from base plate 80. Horizontal slider system 88 includes a rack and pinion mechanism 112, which includes a pinion gear 112*a* fixed to the shaft of motor 110, and a radially disposed rack 112*b* which meshes with the pinion gear, and which is reciprocally translatable in response to rotation of the motor shaft in opposite directions. A pin 114 protrudes vertically upwards from rack 112*b* near the rear or inner radial end of the rack. Pin 114 is radially aligned with lever 96 on slider plate 94, and protrudes above the lower edge of the lever. Thus, when motor 110 is energized in a direction which causes rack 112*b* to move radially outwards, i.e., to the left in FIG. 3, pin 114 abuts lever 96 and pulls horizontal slider plate 94 radially outwardly, thus adjusting the axial tip position of a drill bit 26, in a manner described below. After the tip of drill bit 26 has been thus positioned, motor 110 is powered in a reverse direction, causing rack 112*b* to move to the right in FIG. 3, disengaging linkage between pin 114 and lever 96.

After completion of grinding, dirt removal, and final inspection steps of a drill bit at respective processing units following in sequence after the tip position set up processing unit, an air cylinder (not shown) located at a position between processing unit 21 and loading unit 36 (see FIG. 1) where a processed drill bit is unloaded from processing unit 21 to loading unit 36, pushes radially inwards on lever 96 to restore slider plate 94 to its radially innermost position, or extreme right-hand position in FIG. 3.

Referring now to FIGS. 2 and 3, it may be seen that drill bit holder unit 28 of apparatus includes a vertical slider mechanisms 90 for adjusting the height of the tip of a drill bit 26. Vertical slider mechanism 90 is substantially similar in structure and function to horizontal slider system 88 described above. Thus, as shown in FIG. 3, vertical slider mechanism 90 includes a motor 110*b* which is mounted fixedly to a structure member (not shown) of tip position setup processor unit 38. Vertical slider mechanism 90 also includes a vertically disposed slider plate 94*b* having at its lower end a horizontally disposed, radially outwardly protruding lever 96*b*. As shown in FIG. 2, vertical slider mechanism 90 includes a rack and pinion mechanism 113 comprised of pinion gear 113*a* fixed to the shaft of motor 110*b*, and a vertically disposed rack 113*b* which meshes with the pinion gear. A horizontally disposed pin 115 protrudes radially outwards from rack 113*b*, near the upper end of the rack, the pin being vertically aligned with lever 96*b* protruding radially outwards from vertical slider plate 94*b*. Thus, when motor 110*b* is energized, pin 115 is moved in a vertical direction, and comes into contact with lever 96*b* of vertical slider plate 94*b*, causing the vertical slider plate to move in a vertical direction. This action causes the height of the tip of drill bit 26 to be adjusted, as well as the elevation angle of the shank, in a manner which will now be described in detail.

As shown in FIG. 3, vertical slider mechanism 90 includes a follower plunger 100*b* comprising a headed pin which has a shank which protrudes radially inwardly against the sloping inner surface of a generally vertically disposed depression 95*b* formed in the radially outward vertical surface of vertical slider bar 94. Plunger 100*b* is resiliently pressed against the sloping inner surface of depression 95*b* by a spring (not shown). Thus, an edge support receptacle or yoke 128 which is located at the upper end of an arm 128*a* and supports the tip of a drill bit 26, is pivoted in vertical plane when the lower end of the arm, which is attached to follower plunger 100*b*, is moved outwards and inwards as plate 94*b* is moved downwards and upwards, respectively, thus causing yoke 128 to rotate clockwise and counterclockwise, respectively, and thereby raising or lowering the tip of drill bit 26.

As shown in FIG. 3, the inner end of follower plunger 100*b* is resiliently biased by a spring (not shown) against the sloping inner surface of depression 95*b* in vertical slider plate 94*b*. Thus, since that sloping surface is angled upwardly and outwardly with respect to vertical plane parallel to vertical slider plate 94*b*, downward motion of the vertical slider plate pushes follower plunger radially outwards; thus the upper end of arm 128 attached at its lower end to follower plunger 100*b* is pivoted in a clockwise direction in FIG. 3, changing the inclination angle of a drill bit 26 whose tip is supported by yoke 128 at the upper end of the arm. Lever 96*b* is moved upwards to its uppermost position and lever 96 to its rightmost position at the end of a drill bit processing sequence, by a cam (not shown).

Horizontal slider mechanism 88 adjusts the axial or longitudinal position of the tip of a drill bit 26 relative to base 80, as follows. As shown in FIG. 3, a generally cylindrically-shaped, elongated bore 102 is provided through support body 86, in axial alignment with the longitudinal center line of drill bit 26 held in drill bit holder unit 28. Bore 102 contains an elongated helical compressive spring 106, the upper end of which is retained in the bore by an upper ring-shaped spring retainer 107*a*. The lower end of spring 106 bears resiliently against the annular shoulder of a cylindrical head 107*b* formed at the end of elongated cylindrical push rod 104. Spring 106 causes the upper circular face end of push rod 104 to bear resiliently against the circular shank end face of a drill bit 26, and the lower end face of rod head 107*b*, which protrudes from the rear opening of bore 102, to bear resiliently against the first, upper obliquely angled arm or link 108*a* of a V-shaped link mechanism or bell crank 108. Bell crank 108 also has a second, lower horizontally rearwardly disposed arm or link 108*b*. Bell crank 108 is preferably connected to support 80 by a pivot pin 111 disposed horizontally through link arms 108*a* and 108*b* at their V-shaped junction.

Referring still to FIG. 3, it may be seen that follower plunger 100 is fastened at its upper, head end to the rear end portion of horizontally disposed linkage arm 108*b*. As a result, compressive force exerted on the inner face of push rod head 107*b* by compression spring 106 causes a downward and rearward force to be exerted on the link arm 108*a* of bell crank 108. Thus, bell crank 108 is biased resiliently clockwise around pivot pin 111, as seen in FIG. 3, thus causing horizontal bell crank arm 108*b* to force follower plunger into resiliently compressive contact with the sloping lower surface of depression 96 in horizontal slider plate 94. This compressive force in combination with friction forces exerted on horizontal slider plate 94 by the adjacent walls of slot 92 in support base 80, maintains the slider plate in a fixed position relative to the support base 80. As shown in FIG. 3, radially outward motion of slider plate 94 causes the tip of a drill bit 26 held in holder 28 to move axially forward, while inward motion of the slider plate causes the tip to move axially inward with respect to yoke 128.

Figure 5:
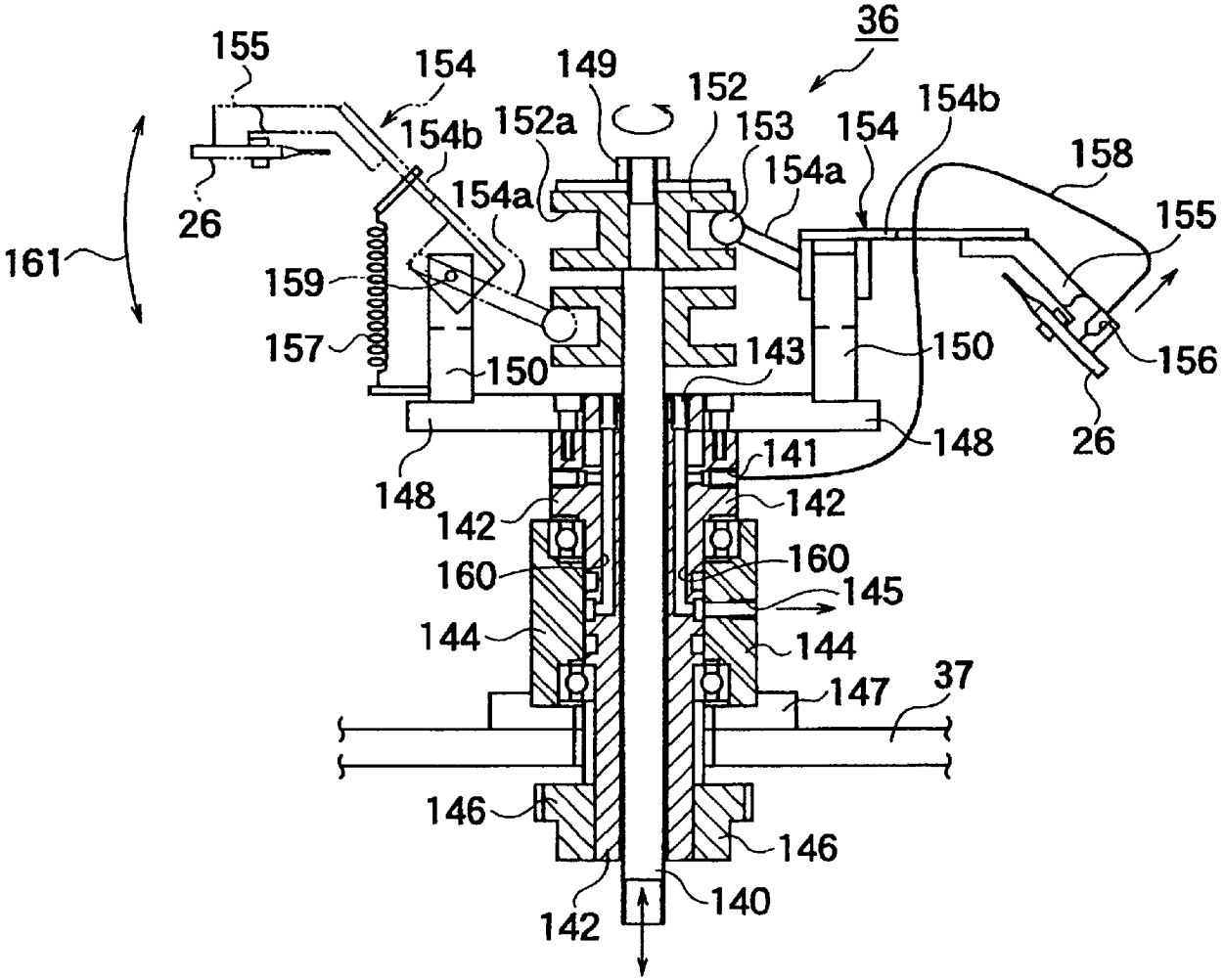
FIG. 5 is a vertical longitudinal sectional view of the loading unit component of the apparatus shown in FIG. 1.

FIG. 5 is a vertical central longitudinal sectional view of loading unit 36 of apparatus 20. Loading unit 36 receives individual drill bits 26 from input/output station 22 and delivers individual bits to drill bit holder units 28 on index plate 22 of processing unit 21. Loading unit 36 has a horizontally disposed base platform 37 which has protruding perpendicularly upwards therefrom a central vertically disposed shaft 140. The lower end of shaft 140 is linked to a pneumatic actuator cylinder (not shown) for moving shaft 140 reciprocally in a vertical direction, as shown by the double headed arrow in FIG. 5. Shaft 140 is located concentrically within the bore of a longitudinally elongated cylindrical sleeve 142. Sleeve 142 has an upper longitudinal portion of larger outer diameter than the lower portion thereof; a rotary pedestal 148 concentrically receives the upper end of the sleeve. Protruding vertically upwards from the upper surface of rotary pedestal 148 are five arm support mounts 150 spaced circumferentially apart at 72-degree intervals. The lower end of sleeve 142 fits within a cylindrical collar 144 located above base plate 37. Collar 144 has disposed radially through a cylindrical side wall thereof a radially disposed vacuum passageway 145 which is connected at an outer radial entrance opening thereof to a vacuum source (not shown), and at an inner radial end thereof to a location radially aligned with a cylindrically-shaped vacuum passageway within sleeve 142. As shown in FIG. 5, passageway 160 inside cylinder 142 has in sectional view an L-shape, the bottom horizontal leg of the L being a sectional view of a ring-shaped opening. The upper end of vacuum passageway 160 is connected to a radially disposed coupling hole 141. A hollow plug-shaped stopcock 143 on the upper end of vacuum passage 160 forms an air-tight seal therewith. Collar 144 is fixed to base plate 37 through a bracket 147. A ring-shaped roller bearing located concentrically within collar 144 allows free rotation of cylinder 142, which passes through the central bearing opening, with respect to base plate 37.

Loading unit 36 includes generally a cylindrically-shaped arm mechanism actuator spool 152 which fits concentrically over the upper end of central shaft 140, and is secured thereto by a nut 149. Actuator spool 152 has a circular plan view shape, and has formed in the cylindrical wall surface thereof an annular ring-shaped groove 152*a* which has in transverse cross section an H-shape. A ball 153 attached to an inner radial end of an inner lever arm 154*a* of each of the five arm mechanisms 154 is pressed resiliently upwardly against the upper surface of groove 152*a* by means of a vertically disposed tension spring 157 connected at an upper end thereof to an outer arm portion 154*b* of arm mechanism 154, and at a lower end thereof to arm mechanism mount bracket 150. The outer end of inner lever arm 154 is joined obliquely by a set screw (not shown) to the inner end of outer arm portion 154*b* at a junction plate which is pivotably mounted by a horizontally disposed pivot pin 159 to the upper end of mount bracket 150. Outer arm 154*b* has attached to its outer end an air chuck arm 155 which releasably holds a drill bit 26 at the outer end of the air chuck arm. When spool 152 is translated down and up by shaft 140, air chuck arm 155 is pivoted from a radially outwardly and downwardly angled orientation, as shown in the right side of FIG. 5, to a horizontally disposed orientation, as shown on the left side of FIG. 5.

As shown in FIG. 5, air chuck 155 has through an outer surface thereof a vacuum passage 156 that makes contact with a drill bit 26 held in the air chuck. A flexible vacuum hose 158 is connected at one end thereof to an inner end of vacuum passage 156. The other end of vacuum hose 158 is connected to coupling hole 141 in cylinder 142. Thus, when vacuum intake hole 145 in collar 144 is coupled to a vacuum source, a pressure reduction is communicated through vacuum passage 160 in cylinder 142, through coupling hole 141, through hose 158 and through vacuum passage 156 in air chuck 155 to the surface of the shank of a drill bit 26 positioned adjacent to the chuck; thus atmospheric pressure forces the shank into contact with opening of vacuum passage 156, and thereby causes the bit to be firmly held in the air chuck.

Referring still to FIG. 5, it may be seen that a driving gear 146 fits concentrically over the lower end of cylinder 142, and is secured to the cylinder. Gear 146 meshes with and is driven by a driving gear attached to a motor (not shown). Thus, when the motor is energized, cylinder 142 and rotary pedestal 148 attached to the upper end of the cylinder are rotated. As rotary pedestal 148 rotates, each of the five arm mechanisms 154 attached to a separate mount 150 protruding upward from the rotary pedestal rotates integrally with the rotary pedestal; and each ball 153 at the inner end of each arm 154*a* rolls in contact with the upper surface of groove 152*a* in spool 152. During this rotary motion, central shaft 140 can be made to move vertically in synchronization with rotary motion of arm 154 relative to spool 152, in response to actuation of the above-mentioned pneumatic cylinder (not shown). Vertical motion of spool 152 in turn causes each air chuck 155 to pivot as indicated by the curved double-headed arrow 161 in FIG. 5. Depending upon the angle formed between air chuck 155 and outer arm 154*b*, the length of arm 154*a*, location of pivot pin 159, and distance of vertical excursion of spool 152 between up and down positions shown in FIG. 5, drill bit 26 can be held in various orientations ranging between vertical and horizontal. In the embodiment of the present apparatus depicted in FIG. 5, the inclination of the shank of drill bit 26 ranges between about 45 degrees, as shown on the right of FIG. 5, to a horizontal orientation, shown on the left of FIG. 5.

The structure and function of tip position set up process unit 38 will now be explained. It will be recalled that inspection process unit 44 has a substantially similar construction, and performs optical imaging functions substantially similar to those of set up process unit.

Figure 6:
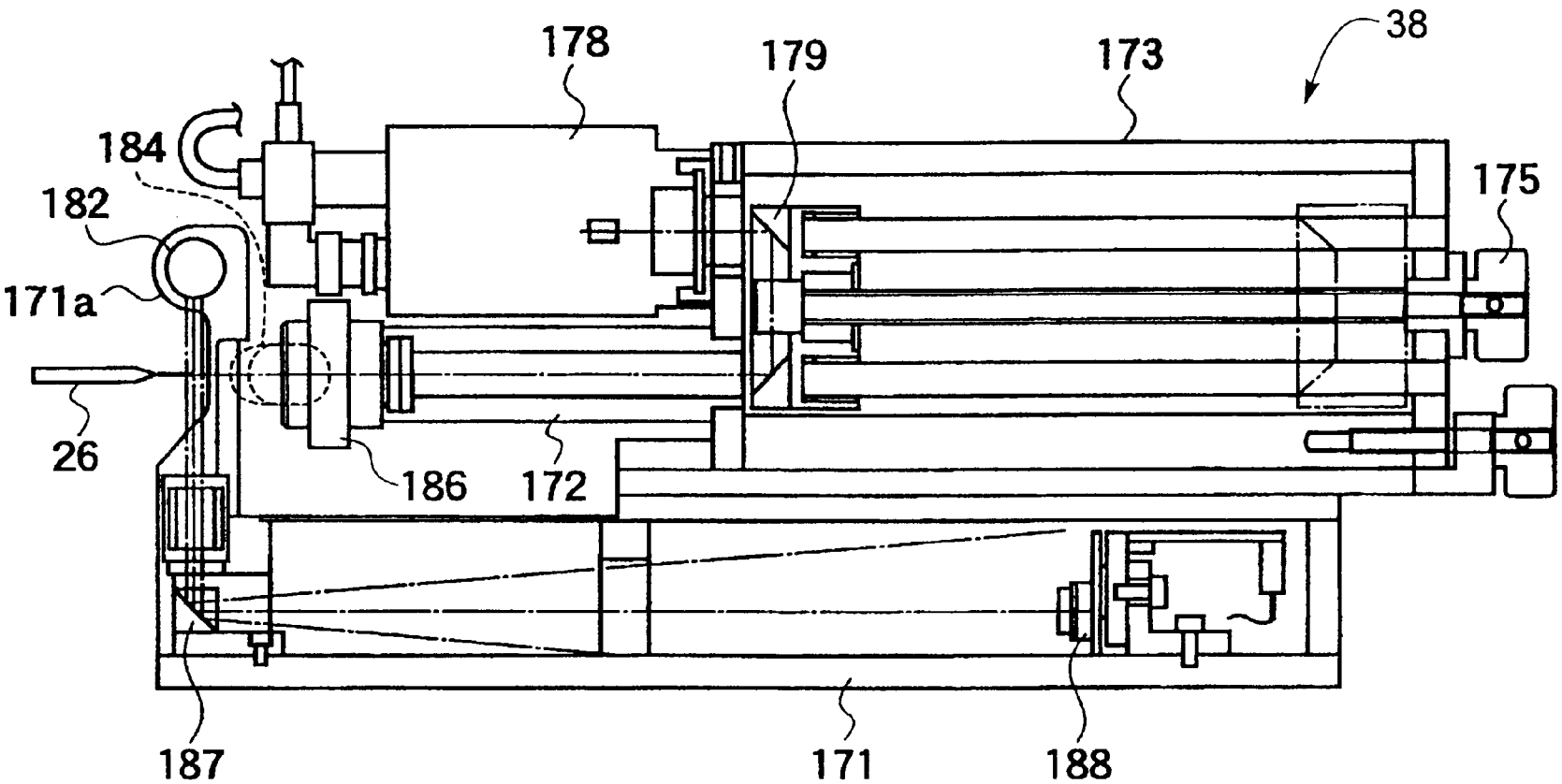
FIG. 6 is a partly vertical sectional, party diagrammatic view of an optical apparatus, similar versions of which comprise a component of both a tip position set up processing unit and inspection processing unit of the apparatus of FIG. 1.
Figure 7:
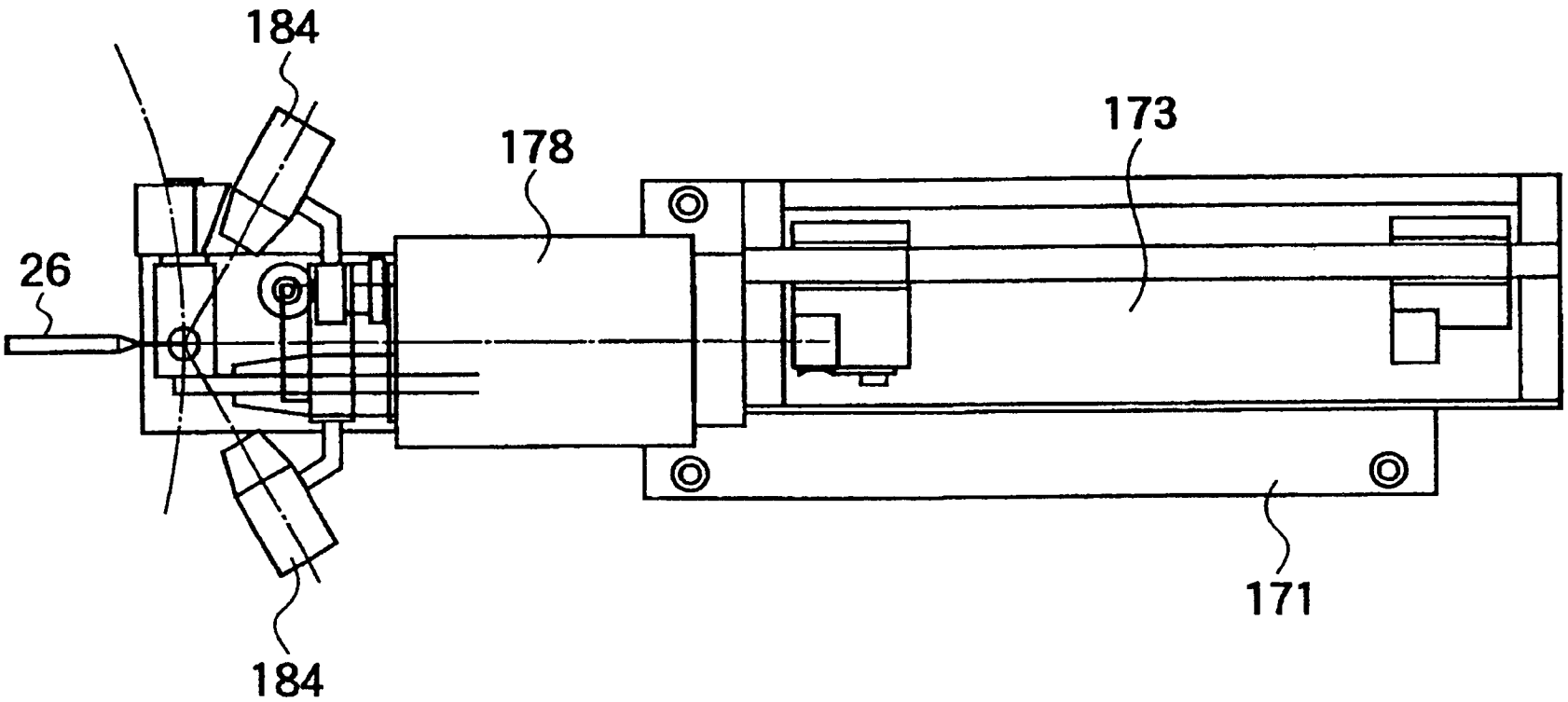
FIG. 7 is an upper plan view of the apparatus of FIG. 6.

Referring now to FIGS. 6 and 7, tip position set up process unit 38 may be seen to include a longitudinally elongated, rectangularly-shaped, box-like mount 171 which has a hollow interior space, and is fixed to a base (not shown) with the longitudinal axis of the mount inclined at an angle of 45 degrees to a radius of index plate 22, as shown schematically in FIG. 1. At the front end (left end in FIG. 6) of mount 171 a bracket 171*a* is provided that extends to the bottom of a field lens 186. A first, upper light source compartment 182 for detecting the position of the tip of a drill bit 26 is attached to a front end part of bracket 171*a*. Light source compartment 182 produces a beam of light which is directed downwardly towards the tip of drill bit 26 towards a prism 187 located within the front end portion of mount 171, the light entering mount 171 through a window.

As shown in FIG. 6, tip position set up process unit 38 includes an optical position control photo sensor 188 located within mount 171 near the rear or right-hand end of the mount. Position control photo sensor 188 faces the exit pupil of prism 187, and has a field of view which includes the exit pupil. Thus, light emitted from light source 182 and illuminating the tip of drill bit 26 enters the entrance pupil of prism 187, is bent 90 degrees, and is detected by position control photo sensor 188. Therefore, when a drill bit held in a drill bit holder unit 28 on index plate 22 is positioned in the space between light source 182 and prism 187, light emitted from source 182 and scattered by the drill bit tip into prism 187 is received by position control photo sensor 188, which generates electrical signals which are used to control the tip position.

As shown in FIGS. 6 and 7, tip position set up process unit 38 includes a longitudinally elongated mirror tube 173 fixed to the upper side of mount 171, in parallel alignment therewith. Protruding longitudinally forward from the front transverse end wall of tubular mirror tube 173 is a telescope tube 172 longitudinally aligned with the longitudinal axis of a drill bit 26.

As shown in FIG. 7, a pair of tight sources 184 located on opposite horizontal sides of the longitudinal optical axis of telescope tube 172, angled obliquely to the optical axis thereof, project beams of light obliquely forward to obliquely illuminate the tip of a drill bit 26. As shown in FIGS. 6 and 7, a CCD camera 178 located above telescope tube 172 and having an optical axis parallel to that of the telescope tube has a rearwardly directed entrance pupil located forward of mirror tube 173. A trapezoid-like prism 179 is located within mirror tube 173, near the front end thereof, the prism being so arranged as to conduct light traveling rearward from the tip of a drill bit 26 illuminated by light sources 184, and passing through field lens 186, onto the focal plane of CCD camera 178, thus allowing the drill bit point to be photographed by the CCD camera. CCD camera 178 is linked to a personal computer (PC) (not shown) and the photographed image of the surface of drill bit tip 26 is displayed on the display monitor of the PC. The PC contains pattern recognition and control software which are responsive to an image of the drill bit tip in generating control signals which are used to adjust the position of the tip and center of a drill bit 26, by controlling horizontal slider motor 110 and vertical slider motor 110*b*, as well as controlling phase adjustment motor 84 to thereby adjust the angular orientation or phase of the drill bit. Mirror tube 173 contains a longitudinally disposed rotatable shaft which at the front end thereof threadingly engages a nut attached to a member which holds prism 179; the rear end of the shaft protrudes outwardly from the rear end wall of mirror tube 173, and has attached thereto a hand wheel and dial which may be turned to thereby move prism 179 longitudinally forward and rearward inside the mirror tube, thus reducing or enlarging the size of the drill bit point image received by the CCD camera.

Figure 8:
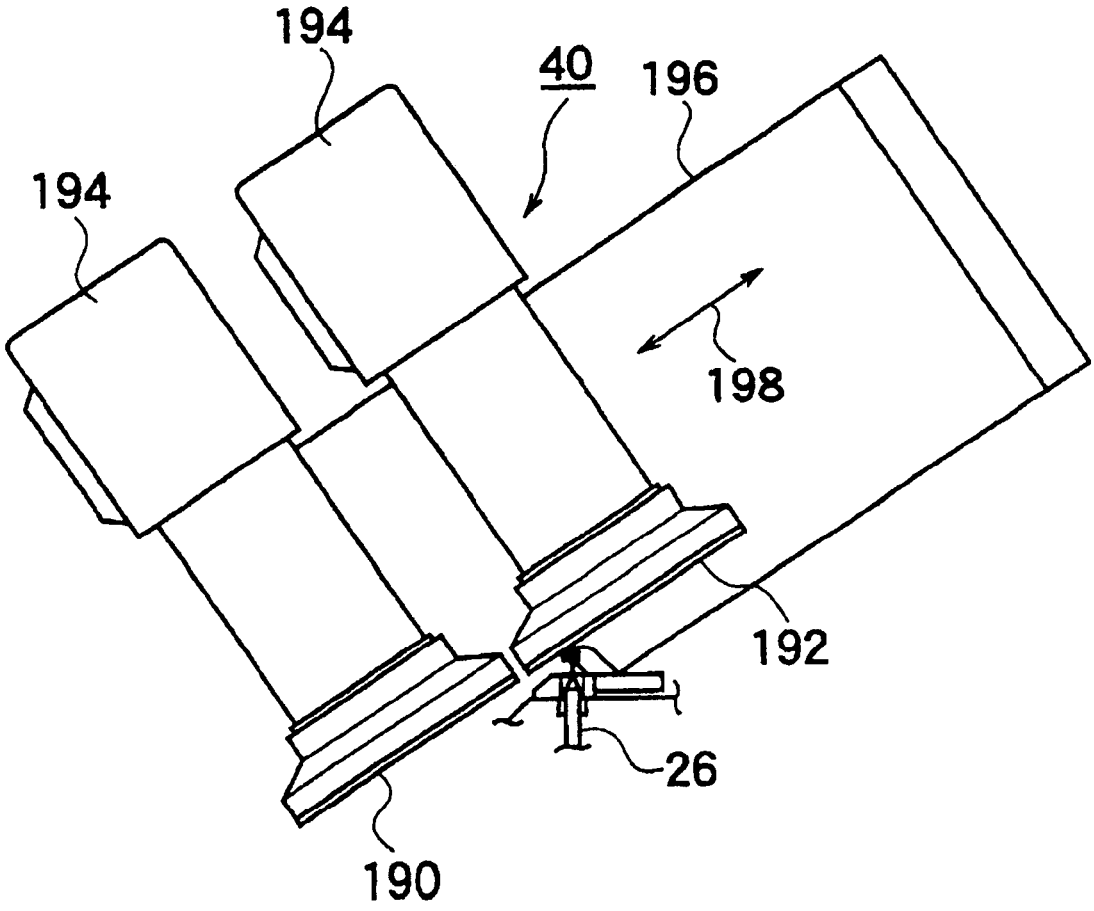
FIG. 8 is a fragmentary upper plan view of a grinding process unit comprising a component of the apparatus of FIG. 1.
Figure 9:
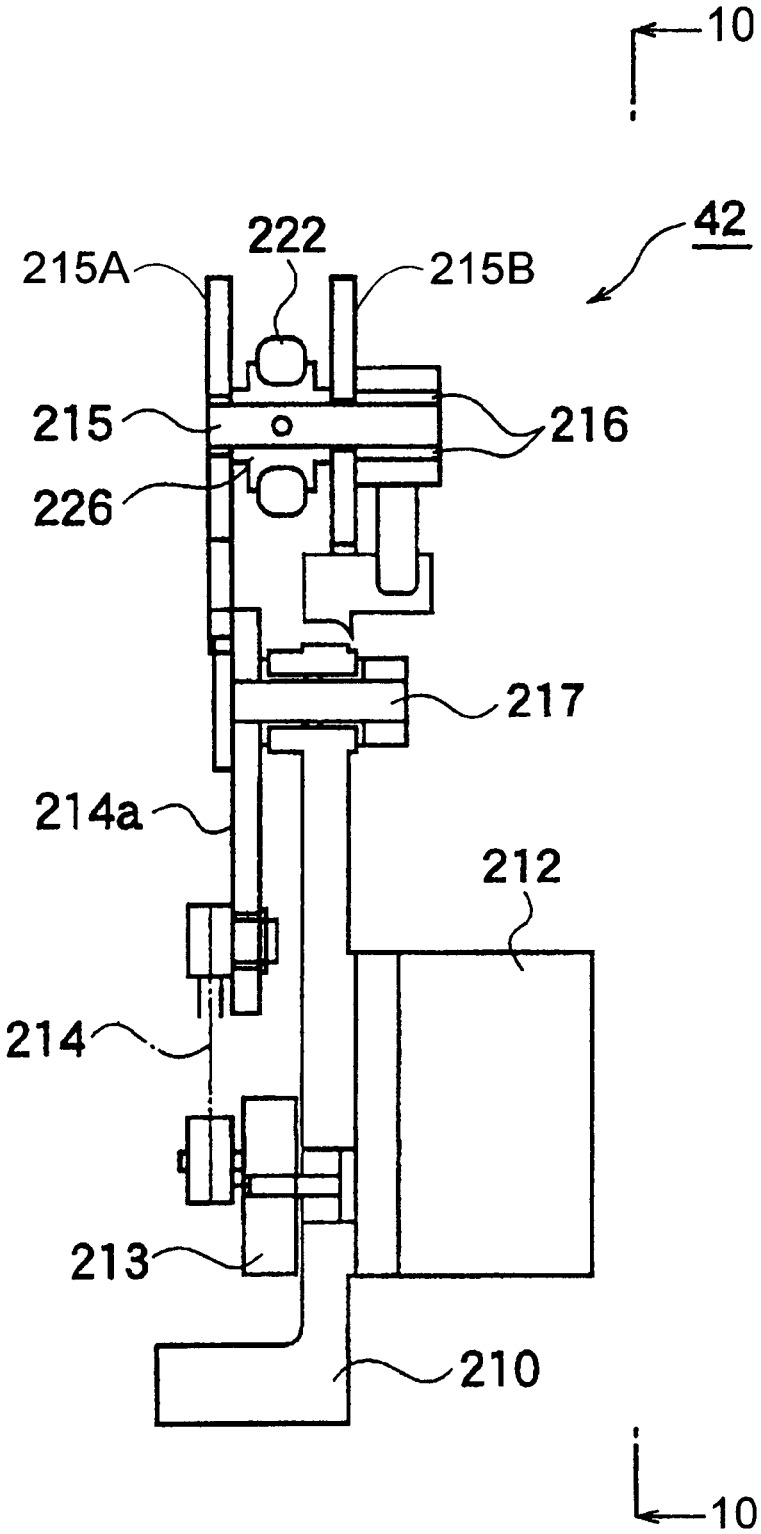
FIG. 9 is a partly sectional front elevation view of a dirt removal processing unit comprising part of the apparatus of FIG. 1.

FIG. 8 illustrates the structure and function of the point grinding processing unit 40 of apparatus 20. As shown in FIG. 8, point processing unit 40 includes a second surface grindstone 190 which is used to grind a second surface of the tip of a drill bit 26, and a third surface grindstone 192 which is used to grind the third surface of the tip. Grindstones 190 and 192 are rotated by a pair of separate drive motors 194, and are inclined at an appropriate bevel angle with respect to the longitudinal axis of the bit, so as to grind second and third surfaces of the drill bit tip to form an appropriate geometrical shape. Moreover, grindstones 190 and 192 are attached to a table 196 which is inclined to the axis of the drill bit, the table being automatically driven by a traverse mechanism, parallel to the longitudinal axis of the table, and obliquely to the drill bit, as shown by the double-headed arrow 198.

Referring now to FIG. 1 in addition to FIG. 8, it may be seen that point processing unit 40 is made to rotate in the direction indicated by the double-headed, curved arrow 40*b*, about axis 40*a*. As shown in FIG. 1, a grindstone face resurfacing machine 40*c* is located next to point processing grindstone unit 40. Machine 40*c* is used to periodically repair or resurface faces of grindstones 190, 192, which become worn after grinding and polishing a sufficient number of drill bits 26. Face dressing machine 40*c* includes separate grindstones for resurfacing second surface grindstone 190 and third surface grindstone 192. The face dressing grindstones are driven by stepper motors and are so constructed and arranged as to be able to cut deeply and automatically into the surfaces of second surface grindstone 190 and third surface grindstone 192, to resurface the two grindstones to predetermined contours. To perform the re-surfacing of grindstones 190 and 192 by re-surfacing machine 40*c*, drill bit pointing unit 40 is periodically made to rotate in the direct 40*b*, thus presenting the second and third surface grindstone to face re-surfacing grindstones in machine 40*c*.

FIGS. 9–13 illustrate the structure and function of a dirt removal processing unit 42. Dirt removal processing unit 42 is used to remove dirt, scrap, grindstone particles, metal chips and other foreign matter from a drill bit 26, both prior to and after the bit has been ground during a re-pointing process. Dirt removal processing unit includes a support 210, to which is attached a synchronous motor 212. A ring 213 fixed to the shaft of motor 212 has attached eccentrically to an outer surface thereof the lower end of a link mechanism 214. The upper end of link 214 is coupled to a lever 214*a*, which is mounted to an upper end portion of support 210 by means of a horizontally disposed shaft 217, thus enabling the lever to pivot in a vertical plane. To the upper end of lever 214*a* is attached a horizontally disposed rotary shaft 215, which rotatably holds a spool-like holder 226. Mounted in a peripheral annular groove of holder 226 is a toroidally-shaped, dirt removal body 222 made of a soft, plastically deformable body which has a tacky surface to which particles of foreign matter on a drill bit readily adhere when the body is pressed into contact with the surface of a drill bit tip. Suitable materials for dir removal body 222 include poly-isobutylene, various synthetic polymer clays and the like. Rotary shaft 215 which supports dirt removal body 222 is coupled to a one-way clutch 216. Lever 214*a* is pivotably coupled to mount 210 through a pivot shaft 217, which enables the lever to pivot forward and backward in nodding-like motion, as indicated by the double-ended arrow 223 in FIG. 10. Thus, when lever 214*a* oscillates in the direction of arrow 223, in response to being driven by motor 212 via wheel 213 and linkage 214, a turning force is applied to the rotary shaft 215 through one-way clutch 216, thus causing dirt removal body 222 to rotate in unison with rotary shaft 215.

Figure 11:
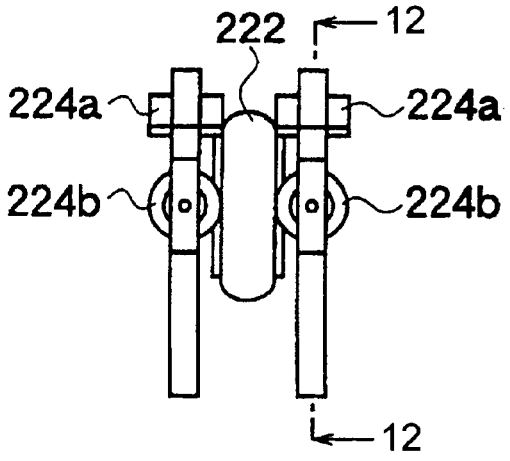
FIG. 11 is a fragmentary end elevation showing the upper part of the dirt removal processing unit of FIG. 9.
Figure 12:
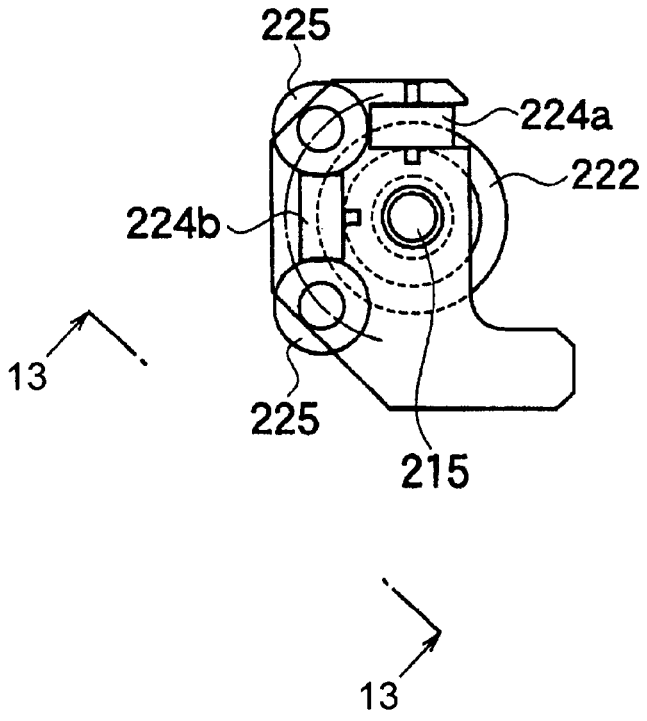
FIG. 12 is a side elevation view of the structure of FIG. 11, taken along line 12—12.
Figure 13:
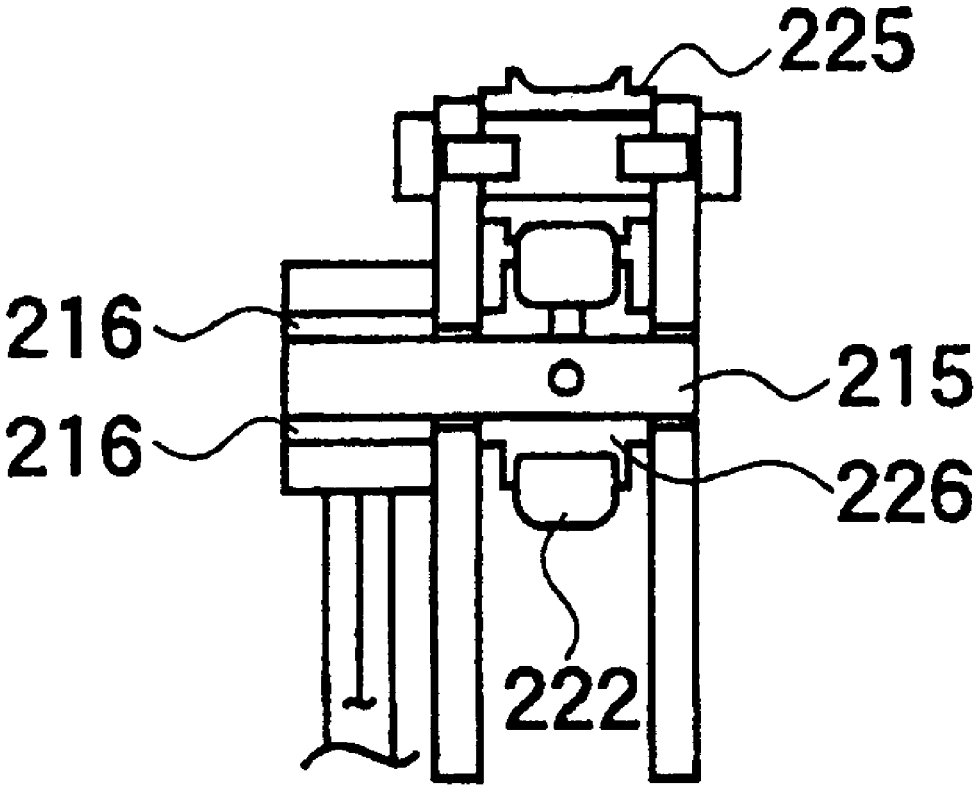
FIG. 13 is an oblique view of the structure of FIG. 12, taken in the direction of line 13—13.

FIGS. 11–13 illustrate an upper part of dirt removal processing unit 42. As shown in FIGS. 11–13, the upper part of dirt removal processing unit 42 includes toroidally-shaped cleaning body 222 mounted on a spool 226 rotatably held on a shaft 215 disposed between parallel vertically disposed side plates 215*a* and 215*b*. As shown in FIG. 11, a pair of laterally spaced apart right and left generally cylindrical column-shaped upper side face dressing rollers 224*a* for reforming and reshaping cleaning body 222 are rotatably mounted on opposite sides of cleaning body 222. Side face dressing rollers 224*a* have vertically disposed axles, and vertically disposed inner cylindrical surfaces which contact opposite vertical faces of cleaning body 222.

As may be seen best by referring to FIGS. 12 and 13, the upper part of dirt removal processing unit 42 includes a pair of vertically spaced apart and aligned, circumferential face dressing rollers 225. Circumferential face dressing rollers 225 are rotatably mounted to plates 215*a* and 215*b* on parallel, horizontally disposed, vertically opposed axles, and each has formed in the outer circumferential surface thereof an arcuately curved groove, which is almost as wide as the roller, and which is adapted to conformally receive the outer circumferential surface of cleaning body 222, as shown in FIG. 13. As shown in FIGS. 11 and 13, the upper part of dirt removal processing unit 42 also includes a pair of laterally spaced apart, right and left, lower side face dressing rollers 224*b* which are similar in construction and function to upper side face dressing rollers 224*a*. However, lower rollers 224*b* have horizontally disposed axles, and are located on the rear side of cleaning body 222 rather than the upper side. The function of the above-described rollers is to repetitively reform and surface-dress toroidally-shaped dirt removal body 222, after each pressing of the body against a tip of a drill bit 26 to remove dirt from the tip. Rotation of dirt removal body 222 occurs as a result of the cyclical nodding motion of arm 214*a*, as described above, and the face dressing rollers are rotated by contact with rotating lateral and circumferential surfaces, respectively, of the dirt removal body. The face dressing rollers are preferably made of a silicone-type material which does not adhere readily to the material from which dirt removal body 222 is made. Dirt removal body 222 is preferably made from a clay-like plastic material, such as poly-isobutylene, polymer clays, and the like.

Inspection processing unit 44 of apparatus 20 is substantially similar in construction and function to tip position set up processing unit 38 shown in FIGS. 6 and 7 and described above. Thus, inspection processing unit 44 also utilizes a tip surface imaging system which displays an image of a drill bit 26 on the monitor screen of a personal computer. Both visual observation and pattern recognition software are used to identify any non-conforming drill bit 26 which has been re-pointed at processing unit station 40, and subsequently cleaned at post-grind dirt removal station 42. As explained above, cleaning each bit 26 at pre-grind dirt removal station 46 reduces the probability of non-recognition of drill bit features at tip position set up processing unit station 38, because of the removal of potentially feature-obscuring dirt from the bit.

As previously explained, a pre-grind dirt removal station 46 is located adjacent to loading unit 36, and cleans each drill bit 26 prior to the bit being loaded off to processing unit 21 from loading unit 36. Thus, arranged in a circle around base plate 37 of loading unit 36 are the aforementioned pre-grind dirt removal processing unit 46, a reject or defective discharge container 48, a ring adjustment unit 50, and a input/output section 52. At both the defectives discharge container 48 and the input/output section 52, there is an input/output gate operated by a conveyor not shown in the figures, the conveyer being arranged to transport a plurality of drill bits in trays.

Figure 14:
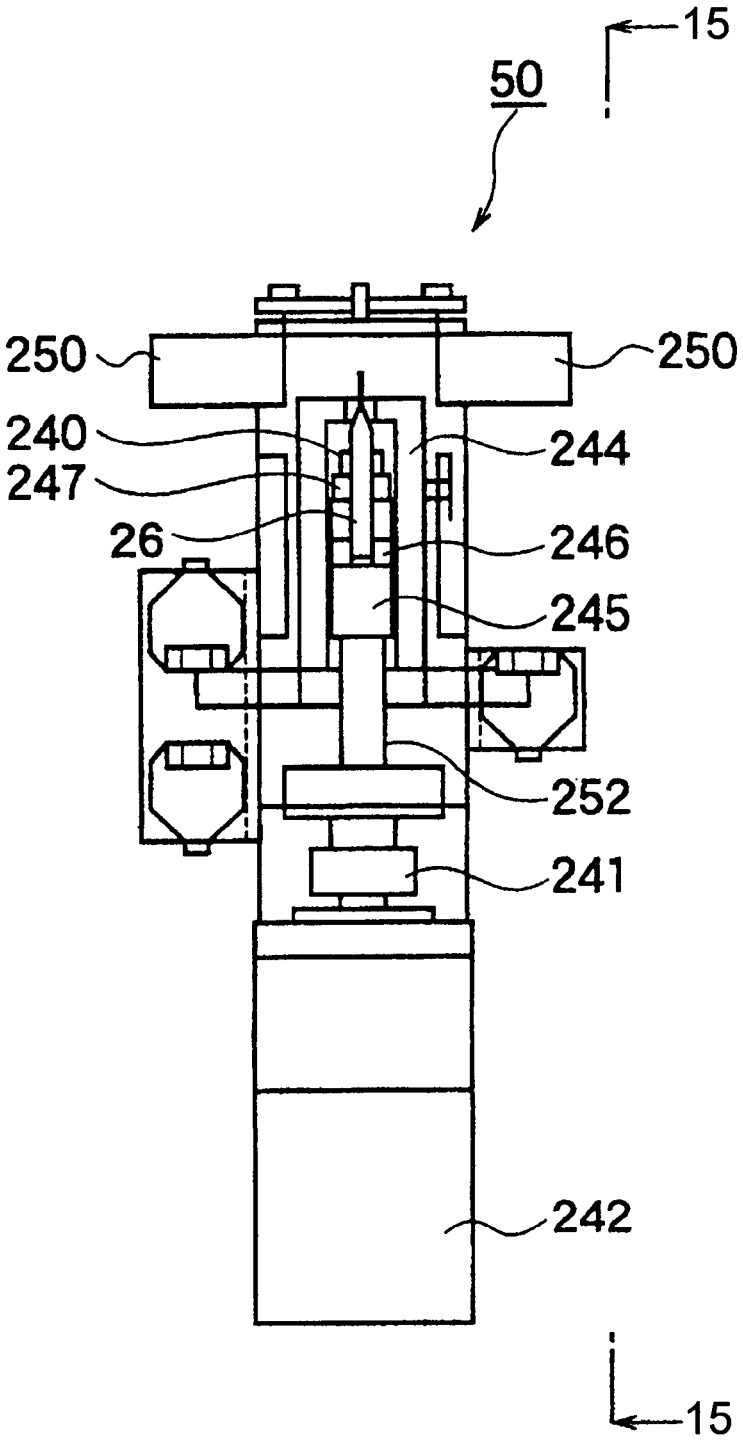
FIG. 14 is an upper plan view of a ring adjustment unit comprising part of the apparatus of FIG. 1.
Figure 15:
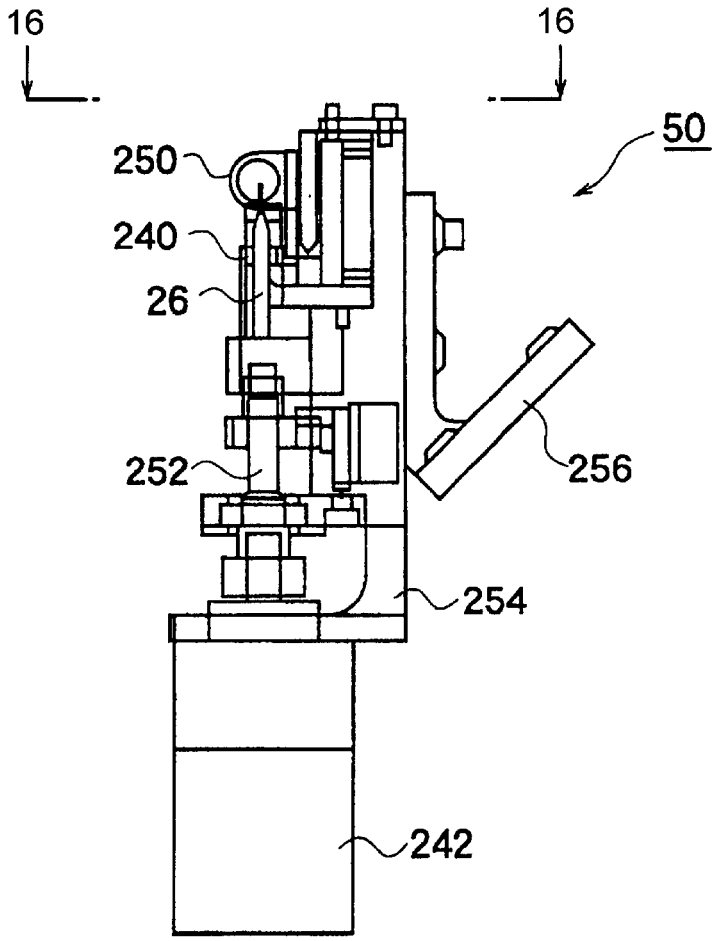
FIG. 15 is a side elevation view of the structure of FIG. 14, taken in the direction of line 14—14.
Figure 16:
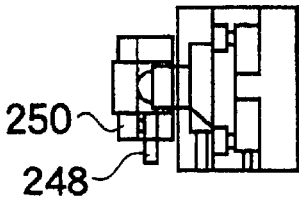
FIG. 16 is an end elevation views of the structure of FIG. 15, taken in the direction of line 15—15.

The structure and function of ring adjustment unit 50 may be best understood by referring to FIGS. 14–16. A primary purpose of ring adjustment unit 50 is to adjust the longitudinal position of a collar ring 240*a* on a drill bit 26, which may have been altered during the processing of the bit by processing uni 21.

As shown in FIG. 15, ring adjustment unit 50 includes a base 254 which protrudes obliquely from an attachment mount plate 256, which is bolted to a fixed support structure (not shown). A motor 242 is attached to base 254. Attached coaxially to the shaft of the motor is a coupling 241, which has protruding axially therefrom a screw 252 which has attached to outer end thereof an enlarged diameter, cylindrically-shaped support block 245 which fits within the bore of a pressure compartment 244. Support block 245 has a flat circular outer or upper face for contacting the butt end of the shank of drill bit 26. Pressure compartment 244 contains a drill receptacle 246 which has a coaxial cavity adapted to receive a drill bit 26 fitted with a collar ring 240. Drill bit 26 is supported by inserting the bit into the cavity of drill receptacle 246. A lever 247 is attached to front or upper sides of drill bit receptacle 246. Radially aligned with tip side of drill bit 26 is a detection compartment 250 that has a sensor 248 (see FIG. 16) which faces opposite to pressure compartment 244. Detection compartment 250 is longitudinally movable by lever 247.

When motor 242 is driven, pressure compartment 244 moves downwardly (FIG. 14) because of rotation of screw 252. When the inner side of the front perforated end wall of pressure compartment 244 comes into contact with the front surface of collar ring 240, the pressure compartment and collar ring move downwardly in unison with respect to the drill bit shank, thereby adjusting the longitudinal position of the collar on the shank. When collar ring 240 contacts lever 247, lever 247 moves in unison with the collar ring, and detection compartment 250 moves in unison with the lever. Movement of pressure compartment 244 is stopped when sensor 248 attached to detection compartment 250 detects the tip of drill bit 26. In this implementation, the distance between the detection position of the tip of drill bit 26 and front surface of collar ring 240 in pressure compartment 244 is set as the standard distance of collar ring 240 from the tip of drill bit 26. After a collar 240 has been pushed rearwards on the shank of a drill bit 26 to this preset distance, motor 242 is powered in a reverse direction, therefore enabling detection compartment 250 to return to its initial position by a spring mechanism not shown in the figures.

Figure 17:
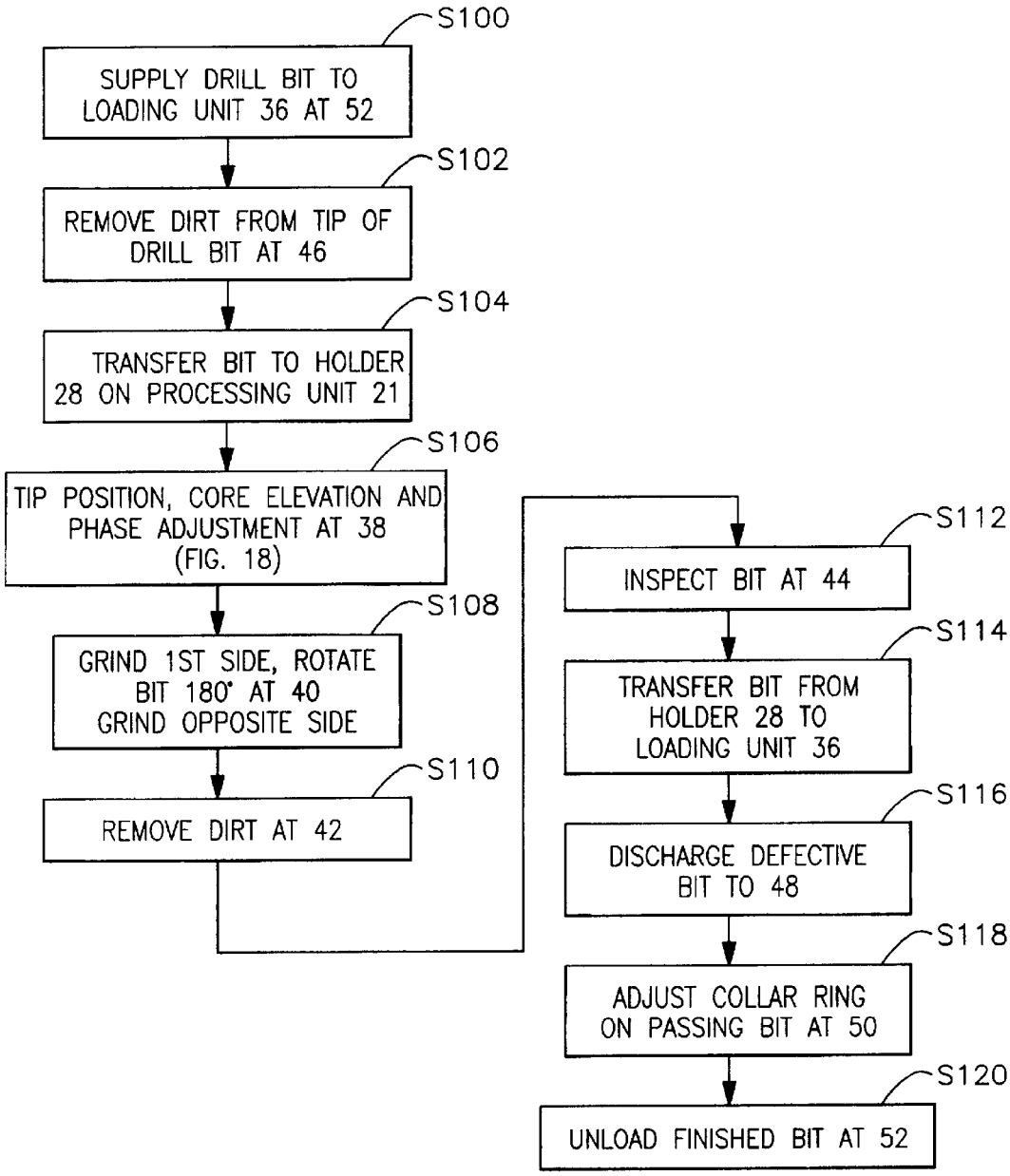
FIG. 17 is a flow chart showing the workflow of the apparatus of FIG. 1.

FIG. 17 is a flow chart illustrating the workflow in processing drill bits 26 using apparatus 20, beginning with step (S100). First, as shown in FIGS. 1 and 5, a drill bit 26 is supplied to loading unit 36, by conveying a tray loaded with a quantity of individual drill bits 26, to input/output section 52, by means of an external air chuck and air cylinder (not shown). Drill bits 26 which is held in a upright vertical position within a container, is tilted 45 degrees towards an air chuck 155, the right-hand air chuck in FIGS. 5, by the action of an air cylinder (not shown) of input/output section 52. At the same time, shaft 140 of loading unit 36 is elevated by a control unit not shown in the figures. Elevation of shaft 140 raises spool 152 attached to the upper end of the shaft to be elevated. This motion causes inner arm 154*a* of right-hand arm mechanism 154 to be raised, and outer arm 154*b* to be lowered, thus lowering air chuck 155 from a horizontal orientation to a 45-degree downwardly inclined orientation. A vacuum source connected to port 156 on air chuck 155 as described above is then energized, producing suction pressure at port 156 which to thereby grip a drill bit 26 in the air chuck. Shaft 140 is then lowered, causing outer arm 154*b* to rotate upwardly to a horizontal position, as shown in phantom on the left side of FIG. 5. Shaft 140 and rotary pedestal 148 are then rotated a fixed angular increment (72 degrees clockwise in a five-station example of the present embodiment), by the driving gear 146, thus air chuck 155 and drill bit 26 of pre-grind dirt removal processing unit 46 (FIG. 1). Note that in this embodiment, loading unit 36 is made to rotate only when shaft 140 is lowered, with drill bit 26 thus being held in a horizontal orientation. After the five incremental rotation of rotary pedestal 148, shaft 140 is again raised, causing air chuck 155 to angle downwards at 45 degrees. Suction of air chuck 155 is then stopped, thereby causing drill bit 26 to be moved to a drill holder mechanism (not shown) of dirt removal processing unit 46.

At pre-grind dirt removal processing unit 46, the tip of drill bit 26 is made to touch dirt removal body 222, thus causing dust, dirt, and other particles of foreign matter covering the tip to adhere to the dirt removal body 222. (S102). After the dirt removal process has been completed, drill bit 26 is picked up by air chuck 155 in the manner described above, loading unit 36 is rotated 72 degrees, and the air chuck 155 holding the cleaned drill bit 26 is thus made to face opposite to a drill bit holder mechanism 28 located on index plate 22 of processing unit 21. Drill bit 26 is then transferred to drill bit holder 28 of processing unit 21 from air chuck 155 of loading unit 36. (S104). At this pickup and delivery or transfer location, shank pressure arm 126 of holder unit 28 is pivoted away from the shank holder by a flat cam (not shown), when air chuck 155 holding a drill bit 26 is axially aligned with and adjacent to the shank holder portion of drill bit holder unit 28. With drill bit 26 still held in air chuck 155, the tip of the drill bit is positioned in edge receptacle 128 of drill bit holder 28, and the shank of the drill bit is positioned in contact with the front end of push rod 104. Vacuum to air chuck 155 is then removed thus enabling the drill bit from air chuck 155 to move to drill bit holder 28. Then, index motor 64 is driven, causing index plate 22 to rotate 72 degrees from the delivery or hand-off position to a position adjacent to tip position set up process unit 38. During this rotation, shank pressure arm 126 is actuated by a flat cam (not shown), which causes shank idler bearing 124 to press down on the shank of drill bit 26, thus holding the bit in drill bit holder 28.

Figure 18:
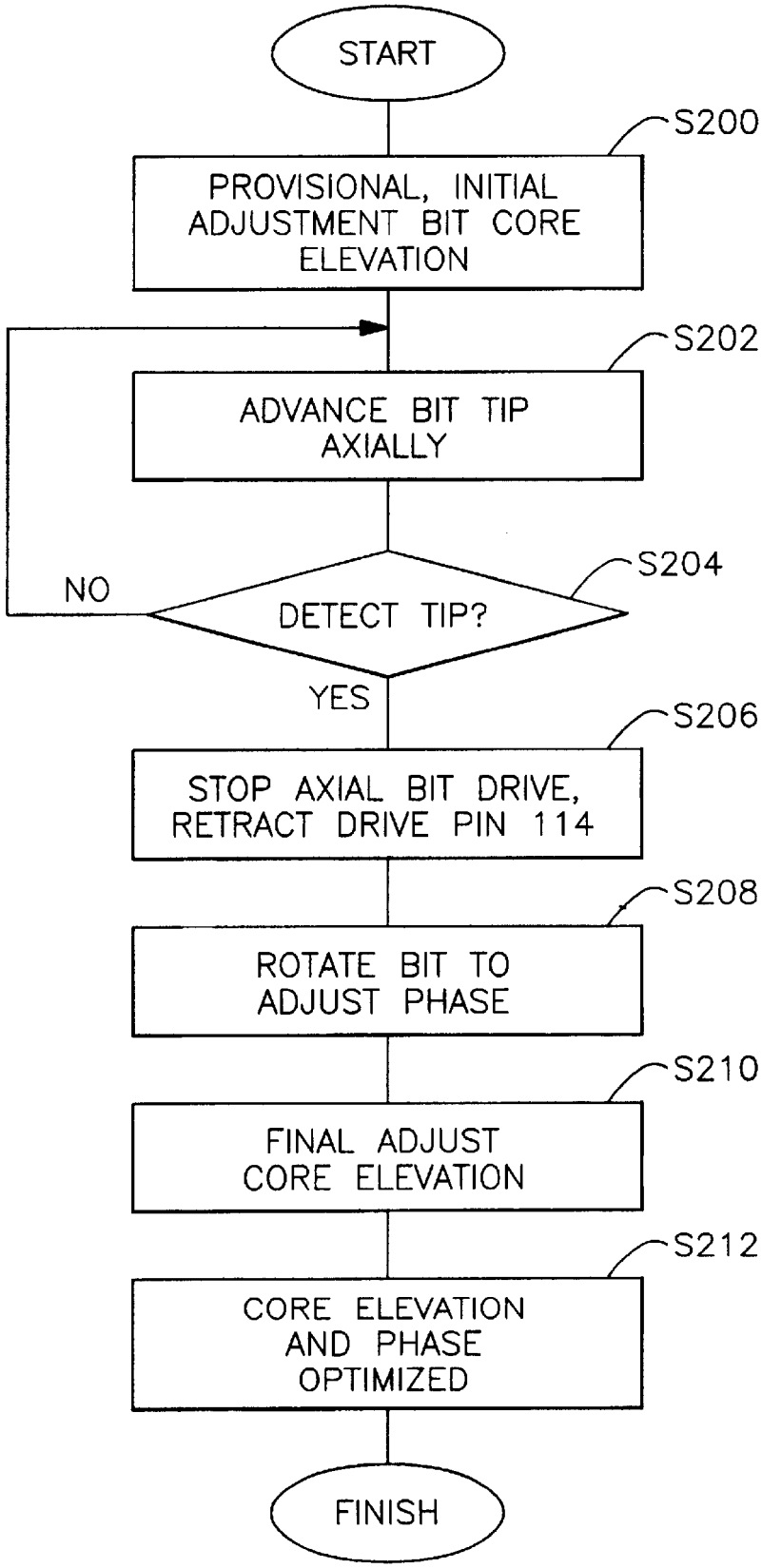
FIG. 18 is a flow chart showing steps in the adjustment of axial tip position, core elevation, and phase adjustment of drill bit processed by the apparatus of FIG. 1.

At tip portion set up process unit 38, the elevation of the center of the core of drill bit 26 is adjusted, as well as the axial position of the tip of the bit, and the phase angle of the flutes (S106). The sequence of steps in the tip portion set up process may be best understood by referring to FIG. 18. FIG. 18 is a flow chart diagram showing the sequence of process steps in adjusting the axial tip position, core elevation, and phase of drill bit 26 with the apparatus of FIG. 20.

A first step in the tip set up process consists of centering the core elevation of drill bit 26 at a temporary provisional position, e.g., at the middle of the adjustment range of the apparatus. (S200). This is done to enable subsequent more precise adjustments of core elevation, axial position and phase angle. During this temporary core center height adjustment step, the tip of drill bit 26 is moved into the field of view of CCD camera 178 by moving tip portion support edge receptacle 128, using vertical slider mechanism 128. Displacement at edge receptacle 128 is under software to an initial predetermined nominal value which positions the tip of drill bit 26 within the field of view of CCD camera 178. (See FIGS. 6 and 7).

Next, horizontal slider motor 110 is energized and the axial tip position of drill bit 26 is adjusted. As shown in FIG. 6, the tip of drill bit 26 is moved until it is detected by tip portion detection sensor 188 (S202). Movement of drill bit 26 is effected by motion of horizontal slider mechanism 88 of drill bit holder 28. Prior to initial movement of horizontal slider mechanism 88, lever 96 of horizontal slider mechanism had been moved by an air cylinder (not shown) to thereby position horizontal slider plate 94 at its radially innermost position, i.e., the right-most position in FIG. 3, thus causing the axial tip portion of drill bit 26 to be at its lowest height. At this time, rack 112*b* and pin 114 of tip position process unit 38 are also located at their radial innermost positions. Thereafter, rack 112*b* moves radially outwards (to the left in FIG. 3) in response to operation of horizontal slider drive motor 110. This action causes pin 114 protruding upwardly from rack 112*b* to engage lever 96 protruding downwardly from slider plate 94, pulling the slider radially outwards, i.e., to the left in FIG. 3, which in turn causes drill bit 26 to ascend. Thus, when horizontal slider plate 94 is moved radially outwards, follower plunger 100 is raised, which in turn causes push rod 104 to move obliquely upwards because of counterclockwise motion of link 108 about pivot pin 111, which causes the upper end of link arm 108*a* to push against cap 107*b* at the rear end of push rod 104. Obliquely upward motion of push rod 104 in turn pushes drill bit 26 axially forward, thus advancing the tip of the drill bit obliquely forward and parallel to the sides of receptacle 128.

Initial movement of drill bit 26 is limited to a movement just sufficient to position the drill bit tip so that it may just be detected in the field of view of position control sensor 188. (S204). Position control sensor 188 then produces a detection signal which is used to stop motor 110, causing forward axial motion of the drill bit tip to cease. (S206). Then, in order to prepare for rotation of index plate 22, horizontal slider drive motor 110 is powered in a reverse direction, causing rack 112*b* and pin 114 to return to their radially innermost, extreme right-hand, starting positions.

Next, phase adjustment of drill bit 26 is performed using the image of the tip surface of the drill bit photographed by CCD camera 178. Referring again to FIG. 4, phase adjustment is accomplished by powering phase adjustment motor 84, thus rotating pinion gear 134, gearwheels 132, and rubber rollers 122, and thereby rotating the shank of drill bit 26, pressed against rubber rollers 122 by idler bearing 124. Phase motor 84 is powered until an image of the drill bit tip photographed by CCD camera 178 indicates that flutes at the front cutting portion of the drill bit are oriented approximately at a predetermined angle relative to a fixed machine reference plane. Then, based upon images of the tip photographed by CCD camera 178, the center (core elevation) position and phase angle of drill bit 26 are readjusted (S210) to predetermined numerical values under software control, in a iterative sequence, a sufficient number of times until the bit position is sufficiently optimized for the grinding end portion of the bit to begin. (S212).

Index plate 22 of processing unit 21 is then rotated to locate the optimally positioned drill bit 26 adjacent to drill bit grinding processing station 40. (S108). Here, grindstones 190, 192 are moved and set obliquely to the drill bit 26 as the traverse mechanism is actuated, thus grinding the bit as shown in FIG. 8. After a side of the drill bit 26 has been ground, the phase of the bit is rotated 180 degrees by powering phase motor 84. The second side is then ground to complete the re-pointing operation.

Figure 10:
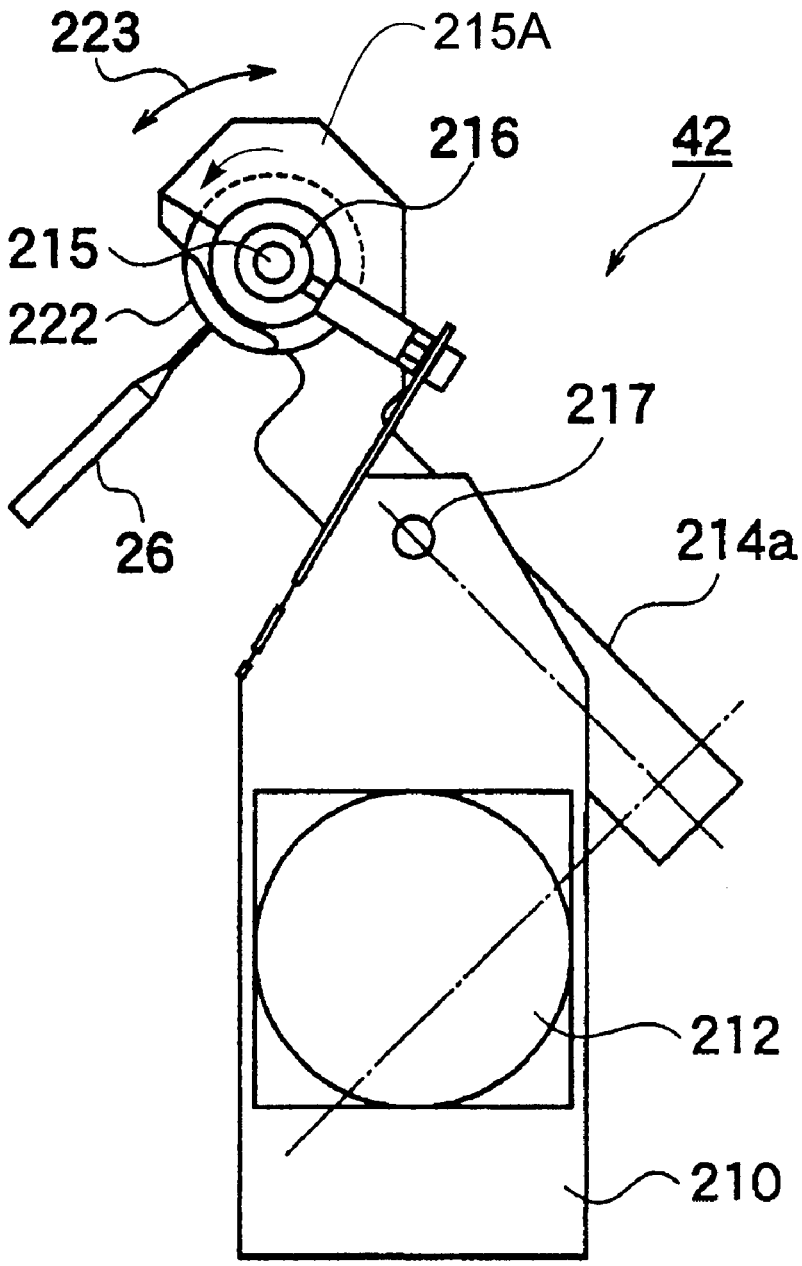
FIG. 10 is a side elevation view of the structure of FIG. 9, taken in the direction of line A—A.

Index plate 22 of processing unit 21 is again rotated to locate the re-pointed drill bit 26 adjacent to post-grind dirt removal process unit 42, which functions exactly the same as pre-grind dirt removal process unit 46. Thus, synchronous motor 212 is powered, causing ring 213 to rotate eccentrically and thereby oscillate the link mechanism 214 connected to the ring. Accordingly, pivoting lever 214*a*, which is coupled to the link mechanism 214, rises and falls as shown by the arrow mark 223 in FIG. 10; during this operation, the tip of the drill bit 26 is inserted into dirt removal body 222 positioned at the upper end of pivot lever 214. When thus inserted, foreign matter adhered to the drill bit is transferred to dirt removal body 222. Pressing dirt removal body 222 against the tip of drill bit 26 is effected by pivoting lever 214 downwardly towards the drill bit tip, i.e., counterclockwise as shown in FIG. 10. As dirt removal body 222 moves downwardly to impact the tip of drill bit 26, dirt removal body 222 is held fixed without rotation. After the tip of drill bit 26 has pierced dirt removal body 222, lever 214*a* moves clockwise, retracting dirt removal body from the drill bit tip. During this motion, dirt removal body 222 is rotated as a result of the one-way clutch, thus causing relative motion between the dirt removal body and face dressing rollers 224 and 225, reforming the dirt removal body to its initial unpierced, toroidal shape.

Index plate 22 of process unit 21 is again rotated to locate re-pointed and cleaned drill bit 26 adjacent to inspection processing unit 44, to determine whether the drill bit meets predetermined quality criteria. (S112). Inspection is performed using electro optical components substantially similar in construction and function to those of tip position set up processing unit 38. However, in the case of a drill bit 26 transported to inspection process station 44, the axial position, center (core elevation) and phase of the drill bit have already been adjusted, so that the drill bit point is prefocused and within the field of view of the CCD camera at the inspection station, thus allowing photographs to be quickly made, and at least two parameters of the re-pointed drill bit compared with predetermined criteria, to thereby determine whether the re-pointed drill bit is acceptable or defective.

Index plate 22 of process unit 21 is again rotated to position pre-pointed, cleaned, and inspected drill bit 26 at a location adjacent to loading unit 36. Here, shank idler bearing 124 is raised, releasing drill bit 26 from holder unit 28, and air chuck 155 of a transfer arm mechanism 154 actuated to pick up the drill bit and thus transfer it to loading unit 36.

The results of the quality assurance inspections made on each drill bit 26 at inspection processing station 44 are stored in electronic memory (not shown). Therefore, when incremental rotation of rotary pedestal 38 of loading 36 has positioned an air chuck 155 holding a defective drill bit 26 adjacent to defectives discharge container 48, that arm mechanism 154 supporting air chuck 155 is automatically actuated to interrupt vacuum to the air chuck and thereby deposit the defective drill bit in the defectives container.

Drill bits 26 which have passed inspection at inspection station 44 are transported on rotary pedestal 38 of loading unit 36 to a location adjacent to ring adjustment unit 50, where a collar ring 240 press fitted onto the shank of the bit is adjusted in the manner described in detail above. Rotating pedestal 38 is then rotated to position a re-pointed and inspected drill bit 26 fitted with a properly adjusted collar ring 240 adjacent to input/output section 152, where an arm mechanism 154 holding the bit is actuated to transfer the bit to a transport container.

The functions of the drill bit pointing and dust removal apparatus according to the present invention and described above are preferably controlled by a transport control unit comprising a microprocessor or general purpose computer such as a personal computer (PC), as will be recognized by and well within the capabilities of one skilled in the art. In a preferred mode of operation, processing unit 21 and circular pedestal 148 are periodically and non-simultaneously rotated to move drill bits between various stations and paused for relatively longer periods to allow sufficient time for processing and loading operations at the various stations to be simultaneously performed.

What is claimed is:

1. An apparatus for processing twist drill bits comprising;

a. a processing unit comprising;

(i) a support structure, (ii) an index plate having mounted thereon at least one drill bit holder for holding a drill bit, (iii) at least a first processing station for performing a first processing operation on a drill bit held in said holder, said first processing station being located adjacent to said index plate at a first index location, (iv) means for movably supporting said index plate by said support structure to thereby move said drill bit holder between said first index location and a load/unload index location adjacent to said index plate and spaced apart from said first index location, and b. loading means located at said load/unload index location for cyclically loading and unloading a drill bit onto and off of said drill bit holder.

2. The apparatus of claim 1 wherein said first processing station is further defined as including thereat a pointing processing unit for machining a surface of a drill bit.

3. The apparatus of claim 2 wherein said pointing processing unit is further defined as including a machining mechanism for machining the front cutting portion including the tip of a drill bit.

4. The apparatus of claim 2 further including a second processing station located adjacent to said index plate at a second index location spaced apart from said first index location, at which is located a dirt removal processing apparatus for removing dirt from a drill bit held in said holder.

5. The apparatus of claim 4 wherein said dirt removal apparatus is further defined as including a plastically deformable body made of a material which has a tacky surface to which dirt readily adheres, said deformable body being movably supported by an actuator mechanism effective in cyclically causing relative approaching motion between said body and the tip of a drill bit to thereby cause said tip to pierce said body, and relative retracting motion to retract said body from said tip after said piercing contact.

6. The apparatus of claim 4 further including a third processing station located adjacent to said index plate at a third location spaced apart from said second index location, at which is located a tip position set-up processing apparatus, said apparatus including sensor means for sensing the position of said drill bit in said holder, and actuator means responsive to control signals generated by said sensor means in moving said drill bit to predetermined spatial coordinate locations relative to said index plate.

7. The apparatus of claim 6 wherein said tip position set-up processing unit is further defined as including a tip position adjustment mechanism for adjusting the tip of said drill bit to a predetermined spatial coordinate position.

8. The apparatus of claim 6 wherein said tip position set-up processing unit is further defined as including a center adjustment mechanism for adjusting the center of said bit to a predetermined spatial coordinate position.

9. The apparatus of claim 6 wherein said tip position set-up processing unit is further defined as including a phase adjustment mechanism for adjusting the rotation angle or phase of said drill bit.

10. The apparatus of claim 6 further including a fourth processing station located adjacent to said index plate at a fourth index location spaced apart from said third index location, at which is located an inspection processing unit for inspecting a drill bit processed at said first, pointing processing station.

11. The apparatus of claim 3 wherein said loading means for cyclically loading and unloading said drill bits from a said drill bit holder is further defined as comprising a loading unit located adjacent to said index plate of said processing unit.

12. The apparatus of claim 11 wherein said loading unit is further defined as comprising;

a. a support structure, b. a movable pedestal having mounted thereon at least one drill bit transfer arm for holding and transferring an individual drill bit, c. at least a first operation station for performing a first operation on a drill bit held by said transfer arm, said first operation station being located adjacent to said pedestal at a first pedestal index location, d. input/output transfer means located at said first pedestal index location for transferring a drill bit from a transport container onto said transfer arm and off of said transfer arm to a transport container, e. means for movably supporting said pedestal by said support structure to thereby move said transfer arm between said first pedestal index location and a load/unload station spaced apart from said first index location and adjacent to said load/unload index location of said processing unit, and f. load/unload transfer means located at said load/unload index location for transferring a drill bit from said transfer arm to said drill bit holder, and from said drill bit holder to said transfer arm.

13. The apparatus of claim 12 further including a second pedestal index location, at which is located a dirt removal processing station.

14. The apparatus of claim 13 further including a third operation station located at a third pedestal index location, said third operation station having thereat a rejects receptacle for receiving defective drill bits.

15. The apparatus of claim 14 further including a fourth operation station located at a fourth pedestal index location, said fourth operation station having thereat a collar ring adjustment mechanism for adjusting the collar ring on a drill bit to be spaced a predetermined distance from the tip of said drill bit.

16. An apparatus for processing twist drill bits comprising;

a. a drill bit processing unit comprising;

(i) a support structure, (ii) an index plate rotatably mounted on said support structure, said index plate having mounted thereon a plurality of drill bit holders located on a circle and spaced circumferentially apart from one another at equal central angles, each drill bit holder being able to hold therein an individual drill bit, (iii) a plurality of processing unit stations spaced apart from said index plate for performing various processing operations on drill bits in said drill bit holders, each of said processing stations being located at an index location located on a circle and spaced circumferentially apart from one another at equal central angles, said processing unit stations including a loading/unloading station for loading an unprocessed drill bit onto a drill bit holder and unloading a processed drill bit from said holder, and at least, a first processing station for performing a process on said drill bit, and (iv) means for rotating said index plate to thereby position an individual drill bit holder at a particular one of said plurality of processing unit stations at said index locations, and b. a drill bit loading unit comprising, (v) a support structure, (vi) a rotary pedestal rotatably mounted on said support structure, said rotary pedestal having mounted thereon a plurality of drill bit transfer arms located on a circle and spaced circumferentially apart from one another at equal angles, each transfer arm being so constructed as to be able to pick up a drill bit from a location exterior to said rotary pedestal, hold said drill bit at a predetermined orientation, and transfer said drill bit to a location exterior to said rotary pedestal, (vii) a plurality of operation stations for performing various operations on individual ones of said drill bits held by said transfer arms, each of said operation stations being located at a rotary pedestal index location located on a circle and spaced circumferentially apart from one another at equal central angles, said operation stations including an input/output station for loading onto an empty transfer arm a drill bit to transfer to said processing unit and for unloading from a transfer arm a drill bit which has been processed by said processing unit, and a load/unload operation station coextensive with said loading/unloading station of said processing unit for transferring a drill bit from a transfer arm on said rotary pedestal to a drill bit holder on said processing unit index plate, and from a drill bit holder to said transfer arm, and (viii) means for rotating said rotary pedestal synchronously with rotation of said index plate, thereby enabling synchronous transfer of drill bits between said rotary pedestal and said index plate.

17. The apparatus of claim 16 wherein said first active processing station is further defined as including thereat a pointing processing unit for machining a surface of a drill bit.

18. The apparatus of claim 17 further including between said loading/unloading index location and said index location of said pointing processing unit a tip position set-up processing apparatus, said apparatus including sensor means for sensing the position of said drill bit in said holder, and actuator means responsive to control signals generated by said sensor means in moving said drill bit to predetermined spatial coordinate locations relative to said index plate.

19. The apparatus of claim 18 wherein said tip position set-up processing unit is further defined as including a tip position adjustment mechanism for adjusting the tip of said drill bit to a predetermined spatial coordinate position.

20. The apparatus of claim 18 wherein said tip position set-up processing unit is further defined as including a center adjustment mechanism for adjusting the center of said bit to a predetermined spatial coordinate position.

21. The apparatus of claim 18 wherein said tip position set-up processing unit is further defined as including a phase adjustment mechanism for adjusting the rotation angle or phase of said drill bit.

22. The apparatus of claim 18 further including a post-grind dirt removal apparatus for removing dirt from a drill bit held in said holder.

23. The apparatus of claim 22 wherein said dirt removal apparatus is further defined as including a plastically deformable body made of a material which has a tacky surface to which dirt readily adheres, said deformable body being movably supported by an actuator mechanism effective in cyclically causing relative approaching motion between said body and the tip of a drill bit to thereby cause said tip to pierce said body, and relative retracting motion to retract said body from said tip after said piercing contact.

24. The apparatus of claim 18 further including a fourth processing station located adjacent to said index plate at a fourth index location spaced apart from said third index location, at which is located an inspection processing unit for inspecting a drill bit processed at said first, pointing processing station.

25. The apparatus of claim 16 wherein said drill bit loading unit is further defined as having at a second rotary pedestal index locating a dirt removal processing station.

26. The apparatus of claim 23 further including a third operation station located at a third pedestal index location, said third operation station having thereat a rejects receptacle for receiving defective drill bits.

27. The apparatus of claim 26 further including a fourth operation station located at a fourth pedestal index location, said fourth operation station having thereat a collar ring adjustment mechanism for adjusting the collar ring on a drill bit to be spaced a predetermined distance from the tip of said drill bit.

28. The apparatus of claim 16 wherein the number of said drill bit holders on said index plate of said processing unit equals the number of arms on said rotary pedestal of said loading unit.

29. The apparatus of claim 28 wherein each of said arms lies in a plane perpendicular to said rotary pedestal and containing a radius of said rotary pedestal.

30. The apparatus of claim 28 wherein each of said drill bit holders lies in a plane which is perpendicular to said index plate and obliquely angled with respect to a radius of said index plate.

31. The apparatus of claim 30 wherein the longitudinal axis of said drill bit in said drill bit holder is obliquely angled with respect to an upper surface of said index plate.

32. A dirt removal apparatus for removing dirt from a drill bit comprising;

a plastically deformable body made of a material which has a tacky surface to which dirt readily adheres, said deformable body being movably supported by an actuator mechanism effective in cyclically causing relative approaching motion between said body and the tip of a drill bit to thereby cause said tip to pierce said body, and relative retracting motion to retract said body after said tip pierces said body.

33. The dirt removal apparatus of claim 32 further including reforming means for restoring said body to an original shape after being deformed in contacting said drill bit tip.

34. The dirt removal apparatus of claim 33 wherein said reforming means comprising at least one roller contacting a surface of said body.

35. The dirt removal apparatus of claim 34 wherein said body has a circular surface for pierceable contact with a drill bit tip.

36. The dirt removal apparatus of claim 35 wherein said body is rollably mounted to said actuator mechanism.

37. The dirt removal apparatus of claim 36 wherein said actuator means includes means for rolling said body while retracting said body from said drill bit tip.

38. The dirt removal apparatus of claim 37 wherein said means for rolling said body is further defined as comprising a one-way clutch coupled between an axle fixed to said body and rollably held by said actuator mechanism, and by an external member fixed to a structure which pivotably supports a housing for said body, thereby enabling said body to be pivoted towards and away from a drill bit tip.

39. A method for processing drill bits comprising the steps of;

a. rotatably supporting on an index plate a plurality of circumferentially spaced apart drill bit holders, b. locating a plurality of processing unit stations spaced radially apart from said drill bit holders, c. rotating said index plate to thereby position a drill bit held in said holder at a particular one of said processing stations located at a first index location, d. automatically loading individual drill bits into individual ones of said drill bit holders, e. automatically and simultaneously performing separate processes on individual drill bits at said processing stations, f. rotating said index plate to position said drill bits at different index locations, and g. unloading individual ones of said drill bits from said holders.

* * * * *